US008603715B2

(12) United States Patent
Amemori et al.

(10) Patent No.: US 8,603,715 B2
(45) Date of Patent: Dec. 10, 2013

(54) TONER AND IMAGE FORMING APPARATUS

(71) Applicants: Suzuka Amemori, Shizuoka (JP); Atsushi Yamamoto, Shizuoka (JP); Masahide Yamada, Shizuoka (JP); Shinya Nakayama, Shizuoka (JP); Hideyuki Santo, Shizuoka (JP); Daiki Yamashita, Kanagawa (JP)

(72) Inventors: Suzuka Amemori, Shizuoka (JP); Atsushi Yamamoto, Shizuoka (JP); Masahide Yamada, Shizuoka (JP); Shinya Nakayama, Shizuoka (JP); Hideyuki Santo, Shizuoka (JP); Daiki Yamashita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/655,720

(22) Filed: Oct. 19, 2012

(65) Prior Publication Data

US 2013/0115550 A1 May 9, 2013

(30) Foreign Application Priority Data

Nov. 9, 2011 (JP) ..... 2011-245712

(51) Int. Cl.
*G03G 9/087* (2006.01)

(52) U.S. Cl.
USPC ..... 430/109.4; 430/109.5; 430/110.1; 430/110.2

(58) Field of Classification Search
USPC ..... 430/109.4, 109.3, 110.2, 110.1, 109.5; 399/252
See application file for complete search history.

(56) References Cited

U.S. PATENT DOCUMENTS

| | | | | |
|---|---|---|---|---|
| 8,007,977 | B2 * | 8/2011 | Inoue et al. | 430/109.4 |
| 2010/0316948 | A1 * | 12/2010 | Sakaguchi et al. | 430/109.4 |
| 2012/0219321 | A1 | 8/2012 | Fukao et al. | |

FOREIGN PATENT DOCUMENTS

| | | |
|---|---|---|
| JP | 2005-215298 | 8/2005 |
| JP | 2010-077419 | 4/2010 |
| JP | 2011-095286 | 5/2011 |
| JP | 2011-123483 | 6/2011 |
| WO | WO-2011/052794 A1 * | 5/2011 |

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A toner including a core particle and projections at a surface of the core particle is provided. The core particle includes a binder resin and a colorant. The binder resin includes a crystalline resin as a major component. Each of the projections consists of a fine resin particle. An average length of long sides of the projections is not less than 0.15 μm and less than 0.5 μm. A standard deviation of lengths of the long sides of the projections is 0.2 or less. A surface coverage of the toner with the projections is within a range of 30 to 90%.

13 Claims, 4 Drawing Sheets

TONER AND IMAGE FORMING APPARATUS

CROSS-REFERENCE TO RELATED APPLICATIONS

This patent application is based on and claims priority pursuant to 35 U.S.C. §119 to Japanese Patent Application No. 2011-245712, filed on Nov. 9, 2011, in the Japan Patent Office, the entire disclosure of which is hereby incorporated by reference herein.

BACKGROUND OF THE INVENTION

1. Technical Field

The present disclosure relates to a toner for developing electrostatic latent images in the field of electrophotography, electrostatic recording, and electrostatic printing. The present disclosure also related to an image forming apparatus containing the toner.

2. Description of the Related Art

An electrophotographic full-color image forming apparatus generally forms an image with toner that comprises colored resin particles.

Recently, such full-color image forming apparatuses are widely used and required to produce images having much higher definition. To meet the requirement for higher-definition images, toner has been developed to be much more spherical and smaller. Thus, polymerization processes, which are generally capable of producing spherical and small toner, such as suspension polymerization, emulsion polymerization, and dispersion polymerization processes, are widely employed as toner production process recently in place of pulverization processes.

However, toner produced by a polymerization process ("polymerization toner") has some drawbacks. One drawback is poor transfer efficiency due to its small size and large adhesive force. Another drawback is poor cleanability (i.e., removability from a photoreceptor) due to its spherical shape. Another drawback is that polymerization toner particles are likely to cause background fouling in resulting images because their surfaces are undesirably low in electric resistivity.

Electrophotographic developing processes are of two types: one-component developing process and two-component developing process. One-component developing process can be reliably performed with a simple and compact apparatus because a process of mixing toner and carrier particles is not needed, which meets a potential requirement for energy-saving and cost reduction. Thus, toner adaptable for one-component developing process is being developed recently.

In one-component developing process, toner particles get through a pressurized gap formed between a developing sleeve and a regulation blade so that the toner particles are charged. At the same time, however, the toner particles are undesirably stressed and degraded.

Moreover, the toner particles may undesirably adhere to the regulation blade or fuse on the developing sleeve without forming a desirable thin layer thereon.

On the other hand, for the purpose of saving energy, toner is required to be fixable at temperatures as low as possible. To meet this requirement, there has been an attempt to include a low-melting-temperature binder resin in toner. As usable low-melting-temperature binder resins, crystalline resins have been proposed that can rapidly melt upon application of heat. There has been another attempt to include a crystalline resin as a primary binder resin in toner.

Such toner having low-temperature fixability is also required to have heat-resistant storage stability. Heat-resistant storage stability may be improved by reforming toner surface by increasing the glass transition temperature thereof. However, merely increasing the glass transition temperature of toner surface would not prevent deformation of toner especially in a high-temperature and high-humidity condition, such as a case in which toner or toner cartridge is in transportation during which toner is generally exposed to a certain pressure. There have been attempts to increase the glass transition temperature and melting temperature of toner in whole.

JP-2010-77419-A describes a crystalline resin particle having specific melting and softening temperatures for improving heat resistance.

JP-2011-123483-A describes a toner having projections at surface of the toner. Each of the projections is formed of fine vinyl resin particles.

JP-2005-215298-A describes a toner having a core including a crystalline polyester and a shell layer including an amorphous polymer.

SUMMARY OF THE INVENTION

In accordance with some embodiments, a toner including a core particle and projections at a surface of the core particle is provided. The core particle includes a binder resin and a colorant. The binder resin includes a crystalline resin as a major component. Each of the projections consists of a fine resin particle. An average length of long sides of the projections is not less than 0.15 μm and less than 0.5 μm. A standard deviation of lengths of the long sides of the projections is 0.2 or less. A surface coverage of the toner with the projections is within a range of 30 to 90%.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
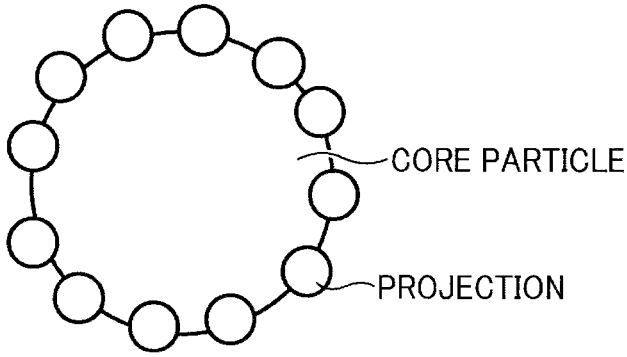
FIG. 1 is a cross-sectional schematic view of a toner according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

According to an embodiment, a toner including a core particle and projections at a surface of the core particle is provided. The core particle includes a binder resin and a colorant. The binder resin includes a crystalline resin as a major component. Each of the projections consists of a fine resin particle. An average length of long sides of the projections is not less than 0.15 μm and less than 0.5 μm. A standard deviation of the lengths of the long sides of the projections is 0.2 or less. A surface coverage of the toner with the projections is within a range of 30 to 90%.

The toner provides a good combination of fixability and heat resistance. The toner also provides uniform chargeability and environmental stability.

With such a configuration in which fine resin particles are forming projections at the surface of a core particle including a crystalline resin as a major component, the toner provides low-temperature fixability, chargeability, filming resistance, cleanability, heat-resistant storage stability, and high-quality image at the same time.

In some cases, a crystalline polyester resin formed from aliphatic monomers rather than aromatic monomers are employed as the crystalline resin for the purpose of improving low-temperature fixability of the toner. Such a crystalline polyester resin formed from aliphatic monomers is generally poor at chargeability. However, even in this case, the toner can provide excellent chargeability by forming the fine resin particles from styrene monomer that have good chargeability. The wide surface area of the toner owing to the presence of the projections also contributes to improvement of chargeability of the toner.

When the surface coverage of the toner with the projections is within a range of 30 to 90%, the fine resin particles cover the surface of the toner while forming spaces between each other and prevent constituents of the core particle (e.g., a release agent) from exuding from the toner. Due to the presence of the projections, the core particle is rarely exposed to frictional forces under normal conditions and therefore the release agents as well as the crystalline resin are prevented from contaminating other members. The release agent exudes from the toner only when the toner is exposed to heat and pressure to be fixed on a recording medium. Because the fine resin particles do not completely cover the core particle and form spaces between each other, the fine resin particles do not prevent the release agent from exuding from the toner.

As described above, the toner includes a core particle and projections at a surface of the core particle. Each of the projections consists of a fine resin particle.

FIG. 1 is a cross-sectional schematic view of the toner according to an embodiment.

The core particle includes a binder resin. The binder resin includes a crystalline resin as a major component. Each of the projections consists of a fine resin particle. According to an embodiment, the fine resin particle includes an amorphous resin.

In this specification, when the binder resin includes a crystalline resin as a major component, it means that the crystalline resin accounts for 50% by weight or more of the toner. When the crystalline resin accounts for 50% by weight or more of the toner, the toner provides a good combination of heat-resistant storage stability and low-temperature fixability. Also, colored resin particles composing the toner have high homogeneity. By contrast, when the crystalline resin accounts for less than 50% by weight of the toner, it may be difficult for the toner to provide both heat-resistant storage stability and low-temperature fixability at the same time.

The average length of long sides of the projections is not less than 0.15 μm and less than 0.5 μm, or 0.3 μm or less. When the average length is 0.5 μm or more, the projections are distributed over the core particle too sparsely. Such a toner is not resistant to stress from a toner regulating blade and likely to fracture. The projections do not satisfactorily reform the surface of the toner.

The standard deviation of the lengths of the long sides of the projections is 0.2 or less, or 0.1 or less. When the standard deviation exceeds 0.2, the surface of the toner is non-uniform. Such a toner being melted on a recording medium is likely to peel off due to the non-uniformity.

The surface coverage of the toner with the projections is within a range of 30 to 90%, 40 to 80%, or 50 to 70%. When the surface coverage falls below 30%, the toner cannot be charged sufficiently and background fouling occurs in resulting image. Also, the toner cannot be prevented from sticking to a toner regulating blade and cannot keep good qualities under pressure or heat. When the surface coverage exceeds 90%, the crystalline resin in the core particle is prevented from being fixed on a recording medium at lower temperatures.

The crystalline resin is included in the toner for improving low-temperature fixability. Usable crystalline resins include, for example, polyester resin, urethane-modified polyester resin, urea-modified polyester resin, polyurethane resin, and polyurea resin. Among these resins, urethane-modified polyester resin and urea-modified polyester resin advantageously provide high hardness while keeping crystallinity.

A crystalline polyester resin can be obtained by a polycondensation of a polyol with a polycarboxylic acid. Usable polyols include, but are not limited to, aliphatic diols such as ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, 1,4-butenediol, 1,10-decanediol, and 1,9-nonanediol. In some embodiments, 1,4-butanediol, 1,6-hexanediol, or 1,8-octanediol is preferably used. In some embodiments, 1,6-hexanediol, ethylene glycol, 1,10-decanediol, or 1,9-nonanediol is more preferably used. Usable polycarboxylic acids include, but are not limited to, aromatic dicarboxylic acids such as phthalic acid, isophthalic acid, and terephthalic acid; and C2-C12 aliphatic carboxylic acids such as adipic acid and 1,10-dodecanedioic acid. Aliphatic carboxylic acids are more advantageous in increasing crystallinity.

A crystalline polyurea resin can be obtained from a reaction among a diamine, a diisocyanate, and optional trivalent or more valent amine and isocyanate.

Usable amines include, but are not limited to, aliphatic amines such as C2-C18 aliphatic diamines and aromatic amines such as C6-C20 aromatic diamines. Trivalent or more valent amines are also usable.

Specific examples of the C2-C18 aliphatic diamines include, but are not limited to, alkylenediamines (e.g., ethylenediamine, propylenediamine, trimethylenediamine, tetramethylenediamine, hexamethylenediamine); C4-C18 polyalkylenediamines (e.g., diethylenetriamine, iminobispropylamine, bis(hexamethylene)triamine, triethylenetetramine, tetraethylenepentamine, pentaethylenehexamine); C1-C4 alkyl substitutes and C2-C4 hydroxyalkyl substitutes of the above compounds (e.g., dialkylaminopropylamine, trimethylhexamethylenediamine, aminoethylethanolamine, 2,5-dimethyl-2,5-hexamethylenediamine, methyliminobispropylamine); alicyclic or heterocyclic aliphatic diamines (e.g., C4-C15 alicyclic diamines such as 1,3-diaminocyclohexane, isophoronediamine, menthene diamine, and 4,4'-methylenedicyclohexanediamine (hydrogenated methylenedianiline); C4-C15 heterocyclic diamines such as piperazine, N-aminoethylpiperazine, 1,4-diaminoethylpiperazine, 1,4-bis(2-amino-2-methylpropyl)piperazine, 3,9-bis(3-aminopropyl)-2,4,8,10-tetraoxaspiro[5,5]undecane); and C8-C15 aromatic aliphatic amines (e.g., xylylenediamine, tetrachloro-p-xylylenediamine).

Specific examples of the C6-C20 aromatic diamines include, but are not limited to, unsubstituted aromatic diamines (e.g., 1,2-, 1,3-, or 1,4-phenylenediamine, 2,4'- or 4,4'-diphenylmethanediamine, crude diphenylmethanediamine (polyphenyl polymethylene polyamine), diaminodiphenyl sulfone, benzidine, thiodianiline, bis(3,4-diaminophenyl) sulfone, 2,6-diaminopyridine, m-aminobenzylamine, triphenylmethane-4-4'-4"-triamine, naphthylenediamine); C1-C4 aromatic diamines having a nuclear-substituted alkyl group (e.g., 2,4- or 2,6-tolylenediamine, crude tolylenediamine, diethyltolylenediamine, 4,4'-diamino-3,3'-dimethyldiphenylmethane, 4,4'-bis(o-tolidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminodiphenyl sulfone) and mixtures with their isomers; aromatic diamines having a nuclear-substituted electron withdrawing group, such as a halogen (e.g., Cl, Br, I, F), an alkoxy group (e.g., methoxy group, ethoxy group), and nitro group (e.g., methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), 4-aminophenyl-2-chloroaniline); and aromatic diamines having a secondary amino group (i.e., the above unsubstituted aromatic diamines, C1-C4 aromatic diamines having a nuclear-substituted alkyl group and mixtures with their isomers, and aromatic diamines having a nuclear-substituted electron withdrawing group, in which a part or all of their primary amino groups are substituted with a secondary amino group by introducing a lower alkyl group such as methyl group or ethyl group) (e.g., 4,4'-di(methylamino)diphenylmethane, 1-methyl-2-methylamino-4-aminobenzene).

Usable trivalent or more valent amines include, but are not limited to, polyamide polyamines, such as a low-molecular-weight polyamide polyamine obtained from a condensation of a dicarboxylic acid (e.g., dimer acid) with an excessive amount of (i.e., 2 mol or more per 1 mol of the acid) a polyamine (e.g., an alkylenediamine, a polyalkylene polyamide); and polyether polyamines, such as a cyanoethylated or hydrogenated polyether polyol (e.g., polyalkylene glycol).

In this specification, the crystalline resin is defined as a resin having a local maximum peak in its endothermic curve obtained by differential scanning calorimetry (DSC), which indicates that the resin has a melting point. As to an amorphous resin, by contrast, its endothermic curve is gradual and does not have local maximum peak, which indicates that the resin has a glass transition point rather than a melting point.

According to some embodiments, the crystalline resin has a melting point (Tm1) within a range of 50 to 70° C., or 55 to 65° C. When the melting point is 50° C. or more, the toner particles neither deform nor stick together even in a high-temperature condition such as in summer. When the melting point is 70° C. or less, the toner is well fixable on recording media.

According to some embodiments, the crystalline resin has a weight average molecular weight within a range of 10,000 to 40,000. When the weight average molecular weight is 10,000 or more, heat-resistant storage stability of the toner is good. When the weight average molecular weight is 40,000 or less, low-temperature fixability of the toner is good.

According to some embodiments, the crystalline resin accounts for 50% by weight or more, 60% by weight or more, or 65% by weight or more, of the toner. When the crystalline resin accounts for 50% by weight or more of the toner, the toner provides both low-temperature fixability and heat-resistant storage stability.

The core particle may further include a resin other than the crystalline resin. Usable resins include amorphous polyester resins, for example.

Usable amorphous polyester resins include either homopolymers of amorphous polyester units or block copolymers of amorphous polyester units with other units. Homopolymers of amorphous polyester units are more advantageous in terms of homogeneity of resulting toner particles. Usable amorphous polyester resins are not limited in molecular structure so long as crystallinity is expressed.

An amorphous polyester resin can be obtained from a reaction between a polyol and a polycarboxylic acid.

Usable polyols and polycarboxylic acids for preparing the amorphous polyester resin include the aforementioned polyols and polycarboxylic acids usable for preparing the crystalline polyester resin. Additionally, ethylene oxide or propylene oxide adducts of bisphenol A, isophthalic acid, terephthalic acid, and derivatives thereof are also usable for preparing the amorphous polyester resin.

In accordance with some embodiments, the toner is prepared by the steps of: dissolving or dispersing constituents of the core particle, such as a binder resin, a colorant, a release agent, etc., in an organic solvent to prepare an oil phase; dispersing the oil phase in an aqueous medium to prepare a dispersion liquid containing droplets of the oil phase (hereinafter "core droplets" for the sake of simplicity); mixing the dispersion liquid containing core droplets with another dispersion liquid containing fine resin particles so that the fine resin particles are adhered to the surfaces of the core droplets; and removing the organic solvent from the core droplets to obtain core particles having the projections at their surfaces.

The projections are effectively formed as the fine resin particles are swelled or dissolved by the organic solvent. The resulting toner particles are uniformly chargeable and well fixable on recording media while keeping heat resistance.

According to another embodiment, the toner is prepared by forming core particles by a dissolution suspension process and mixing the core particles with a dispersion liquid containing fine resin particles in the presence of an organic solvent to form projections. The fine resin particles may include a relatively large amount of styrene units so as to be poorly compatible with the core particles.

The projections may be formed of fine particles of a vinyl polymer having a relatively high hardness. In this case, the toner is prevented from sticking to a regulating blade or a developing sleeve.

In accordance with some embodiments, the crystalline resin includes a first crystalline resin and a second crystalline resin, the weight average molecular weight (Mw) of which is greater than that of the first crystalline resin. The first crystalline resin improves low-temperature fixability and the second crystalline resin improves hot offset resistance.

According to an embodiment, the first crystalline resin is a crystalline polyester and the second crystalline resin is a crystalline resin having urethane and/or urea bond in its backbone. The crystalline resin having urethane and/or urea bond in its backbone may be obtained by elongating a modified crystalline resin having an isocyanate group on its terminal.

The first crystalline resin may also be a crystalline resin having urethane and/or urea bond in its backbone.

In some embodiments, the first crystalline resin has a weight average molecular weight (Mw) within a range of 10,000 to 40,000, 15,000 to 35,000, or 20,000 to 30,000, in view of low-temperature fixability and heat-resistant storage stability of the toner. When Mw falls below 10,000, heat-resistant storage stability of the toner may deteriorate. When Mw exceeds 40,000, low-temperature fixability of the toner may deteriorate.

In some embodiments, the second crystalline resin has a weight average molecular weight (Mw) within a range of 40,000 to 300,000, or 50,000 to 150,000, in view of low-temperature fixability and heat-resistant storage stability of the toner. When Mw falls below 40,000, hot offset resistance of the toner may deteriorate. When Mw exceeds 300,000, the toner may not sufficiently melt at low temperatures and may be fixed on a recording medium with a weak force, causing peeling of the toner image.

In some embodiments, the difference in Mw between the first and second crystalline resins is 5,000 or more, or 10,000 or more. When the difference is less than 5,000, it is likely that a temperature range within which the toner is fixable is narrowed.

In some embodiments, the mixing ratio of the first crystalline resin to the second crystalline resins is 95/5 to 70/30. When the mixing ratio of the first crystalline resin is too large, hot offset resistance of the toner may deteriorate. When the ratio of the first crystalline resin is too small, low-temperature fixability of the toner may deteriorate.

The binder resin may further include a modified crystalline resin having urethane and/or urea group, for adjusting viscoelasticity of the toner. A modified crystalline resin having urethane and/or urea group may be directly included in the binder resin. Alternatively, a relatively low-molecular-weight modified crystalline resin having an isocyanate group on its terminal (hereinafter "prepolymer (A)") along with an amine (B) may be mixed in the binder resin and then subjected to elongating and/or cross-linking reactions to become a modified crystalline resin having urethane and/or urea group during or after the process of forming toner particles. In the latter case, the resulting modified crystalline resin has a relatively high molecular weight and it can be easily included in the toner.

The prepolymer (A) having an isocyanate group may be a reaction product of a polyester having an active hydrogen group, which is a polycondensation product of a polyol (1) with a polycarboxylic acid (2), with a polyisocyanate (3). The active hydrogen group may be, for example, a hydroxyl group (e.g., an alcoholic hydroxyl group, a phenolic hydroxyl group), an amino group, a carboxyl group, or a mercapto group. In some embodiments, an alcoholic hydroxyl group is employed.

Specific examples of the polyisocyanate (3) include, but are not limited to, aliphatic polyisocyanates (e.g., tetramethylene diisocyanate, hexamethylene diisocyanate, 2,6-diisocyanatomethyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic aliphatic diisocyanates (e.g., $\alpha,\alpha,\alpha',\alpha'$-tetramethylxylylene diisocyanate); isocyanurates; the above polyisocyanates in which the isocyanate group is blocked with a phenol derivative, an oxime, or a caprolactam; and combinations thereof.

In some embodiments, the equivalent ratio [NCO]/[OH] of isocyanate groups [NCO] from the polyisocyanate (3) to hydroxyl groups [OH] from the polyester is 5/1 to 1/1, 4/1 to 1.2/1, or 2.5/1 to 1.5/1. When [NCO]/[OH] exceeds 5, low-temperature fixability of the toner may deteriorate. When [NCO]/[OH] falls below 1, hot offset resistance of the toner may deteriorate because urea content in the modified polyester is too low. In some embodiments, the content of units from the polyisocyanate (3) in the prepolymer is 0.5 to 40% by weight, 1 to 30% by weight, or 2 to 20% by weight. When the content falls below 0.5% by weight, hot offset resistance of the toner may deteriorate. When the content exceeds 40% by weight, low-temperature fixability of the toner may deteriorate.

In some embodiments, the average number of isocyanate groups included in one molecule of the prepolymer (A) is 1 or more, 1.5 to 3, or 1.8 to 2.5. When the average number of isocyanate groups falls below 1, hot offset resistance of the toner may deteriorate because molecular weight of the elongated and/or cross-linked modified polyester is too low.

The amine (B) serves as an elongating and/or cross-linking agent. The amine may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane, tetrafluoro-p-xylylenediamine, tetrafluoro-p-phenylenediamine); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine, dodecafluorohexylenediamine, tetracosafluorododecylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

The elongating and/or cross-linking reaction may be terminated by a terminator to adjust molecular weight of the resulting resin. Usable terminators include, but are not limited to, monoamines (e.g., diethylamine, dibutylamine, butylamine, laurylamine) and blocked compounds thereof (e.g., ketimine compounds).

In some embodiments, the equivalent ratio [NCO]/[NHx] of isocyanate groups [NCO] from the prepolymer (A) to amino groups [NHx] from the amine (B) is 1/2 to 2/1, 1.5/1 to 1/1.5, or 1.2/1 to 1/1.2. When [NCO]/[NHx] exceeds 2 or falls below 1/2, hot offset resistance of the toner may deteriorate because the molecular weight of the urea-modified polyester is too low.

According to some embodiments, the projections are formed of fine particles of a vinyl resin. Fine particles of a vinyl resin can be obtained by polymerizing a mixture of monomers primarily including aromatic compounds having a vinyl-polymerizable functional group.

In some embodiments, the aromatic compounds having a vinyl-polymerizable functional group accounts for 70 to 100% by weight, 90 to 100% by weight, or 95 to 100% by weight, of the mixture. When the content of the aromatic compounds having a vinyl-polymerizable functional group is less than 70% by weight of the mixture, chargeability of the toner may be poor.

The vinyl-polymerizable functional group in the aromatic compound may be, for example, vinyl group, isopropenyl group, allyl group, acryloyl group, or methacryloyl group.

Specific examples of the aromatic compounds having a vinyl-polymerizable functional group include, but are not limited to, styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrene sulfonic acid and metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylate, and phenoxypolyalkylene glycol methacrylate.

Among these compounds, styrene is easily available and highly reactive.

The mixture of monomers may further include compounds having both a vinyl-polymerizable functional group and an acid group (hereinafter "acid monomers") in an amount of 0 to 7% by weight. In some embodiments, the content of the acid monomers is 0 to 4% by weight of the mixture. In some embodiments, no acid monomer is included in the mixture. When the content of the acid monomers exceeds 7% by weight of the mixture, the resulting fine vinyl resin particles have high dispersion stability and are not likely to adhere to oil droplets in an aqueous phase at normal temperature. Even in a case in which such fine vinyl resin particles are adhered to oil droplets, the fine vinyl resin particles may easily release therefrom through the succeeding processes of solvent removal, washing, drying, and external treatment. When the content of the acid monomers is 4% by weight or less of the mixture, the resulting fine vinyl resin particles are environmentally stable in terms of chargeability.

The acid group in the acid monomer may be, for example, carboxyl group, sulfonic group, or phosphoric group.

Specific examples of the acid monomers (i.e., compounds having both a vinyl-polymerizable functional group and an acid) include, but are not limited to, vinyl monomers having carboxyl group and salts thereof (e.g., acrylic acid, methacrylic acid, maleic acid, maleic anhydride, monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid), vinyl monomers having sulfonic group, vinyl sulfuric acid monoesters and salts thereof, and vinyl monomers having phosphoric group and salts thereof. In some embodiments, acrylic acid, methacrylic acid, maleic acid, maleic anhydride, monoalkyl maleate, fumaric acid, or monoalkyl fumarate is used.

Vinyl monomers other than the aromatic compounds having a vinyl-polymerizable functional group may also be used: such as vinyl cyans (e.g., acrylonitrile, methacrylonitrile), vinyl halogens (e.g., vinyl chloride, vinyl bromide, chloroprene), vinyl acetate, alkenes (e.g., ethylene, propylene, butylene, butadiene, isobutylene), halogenated alkenes, and polyfunctional monomers (e.g., allyl methacrylate, diallyl phthalate, triallyl cyanurate, monoethylene glycol dimethacrylate, tetraethylene glycol dimethacrylate, glycidyl methacrylate).

Two or more of these compounds can be used in combination. Among these compounds, methoxypolyethylene glycol methacrylate, divinylbenzene, methyl methacrylate, and butyl acrylate are highly reactive and easily available.

Monomers having an ethylene oxide ("EO") chain, such as phenoxyalkylene glycol acrylate, phenoxyalkylene glycol methacrylate, phenoxypolyalkylene glycol acrylate, and phenoxypolyalkylene glycol methacrylate, may also be used for controlling compatibility of the resulting fine vinyl resin particles with the core particles. The content of such monomers may be 10% by weight or less, 5% by weight or less, or 2% by weight or less, of the mixture of monomers. When the content of such monomers exceeds 10% by weight of the mixture, polar groups may be too rich at the surface of the toner, which results in deterioration of environmental stability of the toner. Moreover, the fine vinyl resin particles are too highly compatible with the core particles to be prevented from being embedded therein. Monomers having an ester bond, such as 2-acroyloxyethyl succinate and 2-methacryloyloxyethyl phthalate, are also usable for controlling compatibility of the resulting fine vinyl resin particles with the core particles. The content of such monomers may be 10% by weight or less, 5% by weight or less, or 2% by weight or less, of the mixture of monomers. When the content of such monomers exceeds 10% by weight of the mixture, polar groups may be too rich at the surface of the toner, which results in deterioration of environmental stability of the toner. Moreover, the fine vinyl resin particles are too highly compatible with the core particles to be prevented from being embedded therein.

A dispersion liquid of fine vinyl resin particles may be properly diluted or condensed before being mixed with a dispersion liquid of core particles. In some embodiments, the concentration of fine vinyl resin particles in the dispersion liquid thereof is 5 to 30% by weight, or 8 to 20% by weight. When the concentration of fine vinyl resin particles falls below 5% by weight, the concentration of organic solvent changes significantly at mixing the two dispersion liquids and the fine vinyl resin particles are prevented from adhering to the core particles. When the concentration of fine vinyl resin particles exceeds 30% by weight, the fine vinyl resin particles are likely not to be uniformly dispersed in the dispersion liquid of core particles and are prevented from adhering to the core particles.

The amount of surfactant for preparing the core droplets may be 7% by weight or less, 6% by weight or less, or 5% by weight or less, of the aqueous medium. When the amount of surfactant is too large, the lengths of the long sides of the projections are significantly varied.

When the fine resin particles have high compatibility with the core particles, there is a possibility that projections with a desired shape cannot be formed. The composition of the monomer mixture and/or the polarity and molecular structure of binder resin are properly controlled so as to reduce compatibility between the fine resin particles and the core particles. Additionally, the fine resin particles are designed so as not to be excessively dissolved in organic solvents. If the fine resin particles are well soluble in organic solvents, projections with a desired shape cannot be formed.

Fine vinyl resin particles can be prepared by the following processes (a) to (f).

(a) Directly subject a mixture of monomers to a polymerization, such as a suspension polymerization, an emulsion polymerization, a seed polymerization, or a dispersion polymerization, to obtain a dispersion liquid of fine vinyl resin particles.

(b) Previously subject a mixture of monomers to a polymerization to prepare a vinyl resin, pulverize the resin into particles by a mechanical rotary pulverizer or a jet pulverizer, and classify the particles by size.

(c) Previously subject a mixture of monomers to a polymerization to prepare a vinyl resin, dissolve the resin in a solvent to prepare a resin solution, and atomize the resin solution.

(d) Previously subject a mixture of monomers to a polymerization to prepare a vinyl resin, dissolve the resin in a solvent to prepare a resin solution and further add the solvent to the resin solution, or dissolve the resin in a solvent by application of heat to prepare a resin solution and cool the resin solution, to precipitate fine particles of the resin, and remove the solvent.

(e) Previously subject a mixture of monomers to a polymerization to prepare a vinyl resin, dissolve the resin in a solvent to prepare a resin solution, disperse the resin solution in an aqueous medium in the presence of a dispersant, and remove the solvent by application of heat and/or reduction of pressure.

(f) Previously subject a mixture of monomers to a polymerization to prepare a vinyl resin, dissolve the resin in a solvent to prepare a resin solution, dissolve an emulsifier in the resin solution, and add water thereto to cause phase-transfer emulsification.

The process (a) is simple and is able to prepare fine resin particle in the form of liquid dispersion. Therefore, the process (a) can be easily applicable to toner manufacturing process.

In the process (a), the resulting fine vinyl resin particles may be given dispersion stability by containing a dispersion stabilizer in an aqueous medium within which the polymerization takes place and/or including a monomer which are capable of giving dispersion stability to the fine resin particles (i.e., reactive emulsifier) in the mixture of monomers. In the absence of a dispersion stabilizer and/or a reactive emulsifier, the vinyl resin may not be formed into fine particles. Even in a case in which the vinyl resin can be formed into fine particles, the fine particles are likely to aggregate when stored due to their poor storage stability or to cause aggregation or coalescence of the core particles, resulting in formation of toner particles with nonuniform shapes and surface conditions.

Usable dispersion stabilizers include surfactants and inorganic dispersants. Specific examples of usable surfactants include, but are not limited to, anionic surfactants (e.g., alkylbenzene sulfonates, α-olefin sulfonates, phosphates); cationic surfactants (e.g., amine salt type surfactants such as alkylamine salts, amino alcohol fatty acid derivatives, polyamine fatty acid derivatives, and imidazoline; quaternary ammonium salt type surfactants such as alkyl trimethyl ammonium salts, dialkyl dimethyl ammonium salts, alkyl dimethyl benzyl ammonium salts, pyridinium salts, alkyl isoquinolinium salts, and benzethonium chloride); nonionic surfactants (e.g., fatty acid amide derivatives, polyol derivatives); and ampholytic surfactants (e.g., alanine, dodecyldi(aminoethyl)glycine, di(octylaminoethyl)glycine, N-alkyl-N,N-dimethylammonium betaine). Specific examples of usable inorganic dispersants include, but are not limited to, tricalcium phosphate, calcium carbonate, titanium oxide, colloidal silica, and hydroxyapatite.

In preparing the fine resin particles, a chain transfer agent may be used for adjusting their molecular weight. Usable chain transfer agents include alkyl-mercaptan-type chain transfer agents having a hydrocarbon group having a carbon number of 3 or more. Specific examples of such hydrophobic alkyl-mercaptan-type chain transfer agents having a hydrocarbon group having a carbon number of 3 or more include, but are not limited to, butanethiol, octanethiol, decanethiol, dodecanethiol, hexadecanethiol, octadecanethiol, cyclohexyl mercaptan, thiophenol, octyl thioglycolate, octyl 2-mercaptopropionate, octyl 3-mercaptopropionate, mercaptopropionic acid 2-ethylhexyl ester, octanoic acid 2-mercaptoethyl ester, 1,8-dimercapto-3,6-dioxaoctane, decane trithiol, and dodecyl mercaptan. Two or more of these hydrophobic chain transfer agents can be used in combination.

In some embodiments, the chain transfer agent in an amount of 0.01 to 30 parts by weight, or 0.1 to 25 parts by weight, based on 100 parts by weight of the monomers is added for adjusting molecular weight of the resulting copolymer. When the added amount of the chain transfer agent falls below 0.01 parts by weight, gelation is caused during the polymerization or the molecular weight of the copolymer becomes so large that fixability of the toner deteriorates. When the added amount of the chain transfer agent exceeds 30 parts by weight, the unreacted chain transfer agents remains or the molecular weight of the copolymer becomes so small that the toner contaminates peripheral members.

According to some embodiments, the vinyl resin has a weight average molecular weight of 3,000 to 500,000, 5,000 to 500,000, or 6,000 to 450,000. When the weight average molecular weight falls below 3,000, the vinyl resin is so weak in physical strength that the surface condition of the toner is easily altered depending on toner usage conditions. For example, the toner may significantly change its chargeability or contaminate peripheral members accompanied by deterioration of image quality. When the weight average molecular weight exceeds 500,000, it means that the vinyl resin is deficient in the number of molecular chain terminals. The molecular chains of the vinyl resin become less able to intertangle with molecular chains of the core particles, which means that the vinyl resin particles are prevented from adhering to the core particles.

According to some embodiments, the fine resin particle, which may be a vinyl resin, has a glass transition temperature (Tg) within a range of 45 to 100° C., 60 to 90° C., or 70 to 90° C. When Tg falls below 45° C., the resulting toner may cause blocking when stored in a high-temperature condition.

In some embodiments, the glass transition temperature (Tg) of the fine resin particle, which may be a vinyl resin is greater than the melting point (Tm2) of the toner, i.e., $Tm2<Tg$ is satisfied. When $Tm2<Tg$ is satisfied, the glass transition temperature of the vinyl resin is not significantly reduced even when the vinyl resin is plasticized by moisture in the air when stored in a high-temperature and high-humidity condition. Also, the resulting toner is not significantly degraded even when exposed to frictional forces in one-component developing processes. When Tm2<Tg is satisfied, the toner is also fixable at low temperatures.

According to some embodiments, when the toner is subjected to first and second heating processes by a differential scanning calorimeter, the ratio (Tsh2nd/Tsh1st) of the second shoulder temperature (Tsh2nd) of the second peak of melting heat observed in the second heating process to the first shoulder temperature (Tsh1st) of the first peak of melting heat observed in the first heating process is within a range of 0.90 to 1.10, i.e., $0.90 \leq Tsh2nd/Tsh1st \leq 1.10$ is satisfied.

The shoulder temperatures (Tsh1st and Tsh2nd) of the peaks of melting heat can be measured by a differential scanning calorimeter such as TA-60WS or DSC-60 (both from Shimadzu Corporation) as follows. Contain 5.0 mg of a toner in an aluminum sample container and set the container to a holder unit in an electric furnace. In nitrogen atmosphere, heat the sample from 0° C. to 150° C. at a heating rate of 10° C./min to obtain a first DSC curve. Subsequently, cool the sample from 150° C. to 0° C. at a cooling rate of 10° C./min and further heat the sample to 150° C. at a heating rate of 10° C./min to obtain a second DSC curve. Designate an endothermic peak temperature observed in the first DSC curve as Tm1st and an endothermic peak temperature observed in the second DSC curve as Tm2nd. In a case in which multiple endothermic peaks are observed in each DSC curve, select a peak which is expressing the maximum endothermic quantity. Determine an intersection of the lower-temperature-side baseline of each DSC curve with the tangent line of the lower-temperature-side slope of each selected endothermic peak. Designate the temperatures at the intersections in the first and second DSC curves as Tsh1st and Tsh2nd, respectively.

According to some embodiments, the toner satisfies the following inequations: $G'(70) \geq 1.0 \times 10^3$, $5.0 \times 10^3 < G'(70) < 5.0 \times 10^6$, or $5.0 \times 10^4 < G'(70) < 5.0 \times 10^5$, wherein G'(70) (Pa) represents a storage elastic modulus of the toner at 70° C. According to some embodiments, the toner satisfies the following inequations: $G'(160) \leq 5.0 \times 10^6$, $1.0 \times 10^1 < G'(160) < 5.0 \times 10^5$, or $1.0 \times 10^3 < G'(160) < 1.0 \times 10^4$, wherein G'(160) (Pa) represents a storage elastic modulus of the toner at 160° C. When storage elastic modulus is within the above-described ranges, the toner provides high fixation strength and hot offset resistance.

Storage elastic modulus can be adjusted by varying the mixing ratio of crystalline and amorphous resins or molecular weight of the resins. For example, as the ratio of the crystalline resin increases, G'(160) increases.

Storage elastic modulus can be measured by a dynamic viscoelasticity measuring device such as ARES (from TA Instruments) as follows.

Cast a sample into a pellet having a diameter of 8 mm and a thickness of 1 to 2 mm. Fix the pellet to parallel plates having a diameter of 8 mm and stabilized at 40° C. Subject the pellet to a measurement by heating the pellet to 200° C. at a heating rate of 2.0° C./min while setting the frequency to 1 Hz (6.28 rad/s) and the amount of strain to 0.1% (under strain control mode).

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G; LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. In some embodiments, the content of the colorant in the toner is 1 to 15% by weight or 3 to 10% by weight.

The toner may include a release agent. Specific examples of usable release agents include, but are not limited to, polyolefin waxes (e.g., polyethylene wax, polypropylene wax), long-chain hydrocarbons (e.g., paraffin wax, Fischer-Tropsch wax, SAZOL wax), and carbonyl-group-containing waxes. Specific examples of the carbonyl-group-containing waxes include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine dibehenylamide), polyalkylamides (e.g., trimellitic acid tristearylamide), and dialkyl ketones (e.g., distearyl ketone). Among the above release agents, polyolefin waxes and long-chain hydrocarbons, such as paraffin wax and Fischer-Tropsch wax, desirably have low polarity and melt viscosity.

The toner may further include a release agent dispersant. As the release agent dispersant, the following materials may be used: a polymer or oligomer comprised of a block unit having high compatibility with release agent and another block unit having high compatibility with binder resin; a polymer or oligomer comprised of a unit having high compatibility with release agent and another unit having high compatibility with binder resin, one of them is grafted to the other; a copolymer of an unsaturated hydrocarbon (e.g., ethylene, propylene, butene, styrene, α-styrene) with an α,β-unsaturated carboxylic acid or an ester or anhydride thereof (e.g., acrylic acid, methacrylic acid, methyl methacrylate, maleic acid, maleic anhydride, itaconic acid, itaconic anhydride); and a block or graft copolymer of a vinyl resin with a polyester.

The toner may further include fine particles of an inorganic material ("inorganic fine particles") on the surface thereof as an external additive that improves fluidity, developability, and chargeability. In some embodiments, the inorganic fine particles have a primary particle diameter of 5 nm to 2 μm or 5 nm to 500 nm. In some embodiments, the inorganic fine particles have a BET specific surface area of 20 to 500 $m^2/g$. In some embodiments, the inorganic fine particles account for 0.01 to 5% by weight, or 0.01 to 2.0% by weight, of the toner. Specific examples of usable inorganic fine particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Additionally, fine particles of polymers may also be used as the external additive. Usable polymers include, for example, polystyrene that can be obtained by soap-free emulsion polymerization, suspension polymerization, or dispersion polymerization; polycondensation resins such as copolymers of methacrylates and acrylates, or silicone, benzoguanamine, or nylon resin; and thermosetting resins.

The external additives may be treated with a surface treatment agent so as to improve hydrophobicity. The hydrophobized external additive can prevent deterioration of fluidity and chargeability of the toner in high-humidity conditions. Usable surface treatment agents include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so as to be easily removable from a photoreceptor or a primary transfer medium when remaining thereon after image transfer. Specific examples of usable cleanability improving agents include, but are not limited to, metal salts of fatty acids (e.g., zinc stearate, calcium stearate) and fine particles of polymers which can be prepared by soap-free emulsion polymerization (e.g., polymethyl methacrylate, polystyrene). In some embodiments, the fine particles of polymers have a narrow size distribution and a volume average particle diameter of 0.01 to 1 μm.

In accordance with some embodiments, the toner is prepared by the steps of: dissolving or dispersing constituents of the core particle, such as a binder resin, a colorant, a release agent, etc., in an organic solvent to prepare an oil phase; dispersing the oil phase in an aqueous medium to prepare a dispersion liquid containing droplets of the oil phase (hereinafter "core droplets" for the sake of simplicity); mixing the dispersion liquid containing core droplets with another dispersion liquid containing fine resin particles so that the fine resin particles are adhered to the surfaces of the core droplets; and removing the organic solvent from the core droplets to obtain core particles having the projections at their surfaces.

Usable organic solvents include volatile solvents having a boiling point less than 100° C. that are easily removable in succeeding processes. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. In some embodiments, ester solvents such as methyl acetate and ethyl acetate, aromatic solvents such as toluene and xylene, and halogenated hydrocarbons such as 1,2-dichloroethane, chloroform, and carbon tetrachloride are used. The binder resin and colorant may be dissolved or dispersed in either a single organic solvent together or separate organic solvents. In the latter case, the separate organic solvents may be either identical or different. When the separate organic solvents are identical, succeeding solvent removing processes become much simpler. According to some embodiments, either single or mixture solvents which dissolve the binder resin poorly dissolve the release agent.

A solution or dispersion of the binder resin may have a resin concentration of 40 to 80%. When the resin concentration is too high, the solution or dispersion gets too viscous to be handled with ease. When the resin concentration is too low, the yield of core particles decreases while the waste solvent increases. In a case in which the binder resin comprises a crystalline polyester and a modified polyester having an isocyanate group on its terminal, the crystalline polyester and the modified polyester may be dissolved or dispersed in either a single organic solvent together or separate organic solvents. The latter case more takes into account solubility and viscosity of each polyester.

The aqueous media may be, for example, water alone or a mixture of water and a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone). According to an embodiment, the used amount of the aqueous medium is 50 to 2,000 parts by weight, or 100 to 1,000 parts by weight, based on 100 parts by weight of the core particles.

The aqueous medium may contain an inorganic dispersant or an organic resin particle for the purpose of stably dispersing the oil phase therein and narrowing particle size distribution of the core droplets. Specific examples of usable inorganic dispersants include, but are not limited to, tricalcium phosphate, calcium carbonate, titanium oxide, colloidal silica, and hydroxyapatite. The organic resin particle may be prepared from a resin capable of forming an aqueous dispersion thereof. Such resins include thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Among the above resins, a vinyl resin, a polyurethane resin, an epoxy resin, a polyester resin, or a combination thereof are much easier to form an aqueous dispersion of fine spherical particles thereof.

In the process of preparing an aqueous dispersion of the organic resin particle, a surfactant may be used, if needed. Specific examples of usable surfactants include, but are not limited to, anionic surfactants (e.g., alkylbenzene sulfonates, α-olefin sulfonates, phosphates); cationic surfactants (e.g., amine salt type surfactants such as alkylamine salts, amino alcohol fatty acid derivatives, polyamine fatty acid derivatives, and imidazoline; quaternary ammonium salt type surfactants such as alkyl trimethyl ammonium salts, dialkyl dimethyl ammonium salts, alkyl dimethyl benzyl ammonium salts, pyridinium salts, alkyl isoquinolinium salts, and benzethonium chloride); nonionic surfactants (e.g., fatty acid amide derivatives, polyol derivatives); and ampholytic surfactants (e.g., alanine, dodecyldi(aminoethyl)glycine, di(octylaminoethyl)glycine, N-alkyl-N,N-dimethylammonium betaine).

In particular, surfactants having a fluoroalkyl group are effective in small amounts. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl (C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates. Specific examples of usable cationic surfactants having a fluoroalkyl group include, but are not limited to, aliphatic primary, secondary, and tertiary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts.

Additionally, polymeric protection colloids are usable as a dispersion stabilizer. Specific examples of usable polymeric protection colloids include, but are not limited to, homopolymers and copolymers of monomers such as acids (e.g., acrylic acid, methacrylic acid, α-cyanoacrylic acid, α-cyanomethacrylic acid, itaconic acid, crotonic acid, fumaric acid, maleic acid, maleic anhydride); acrylic and methacrylic monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide); vinyl alcohols; vinyl alcohol ethers (e.g., vinyl methyl ether, vinyl ethyl ether, vinyl propyl ether); esters of vinyl alcohols with compounds having carboxyl group (e.g., vinyl acetate, vinyl propionate, vinyl butyrate); acrylamide, methacrylamide, diacetone acrylamide, and methylol compounds thereof; acid chlorides (e.g., acrylic acid chloride, methacrylic acid chloride); and nitrogen-containing compounds or nitrogen-containing heterocyclic compounds (e.g., vinylpyridine, vinylpyrrolidone, vinylimidazole, ethyleneimine). Additionally, polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester) and celluloses (e.g., methyl cellulose, hydroxyethyl cellulose, hydroxypropyl cellulose) are also usable. In a case in which a compound soluble in acids and/or bases (e.g., calcium phosphate) is used as a dispersion stabilizer, such a compound can be removed by washing the resulting particles with an acid (e.g., hydrochloric acid) first and then water. Alternatively, such a compound can be removed by being decomposed by an enzyme. The dispersion stabilizer may either remain on or be removed from the resulting toner particles, but the latter is preferable in view of chargeability.

Any type of disperser can be used, such as a low-speed shearing disperser, a high-speed shearing disperser, a frictional disperser, a high-pressure jet disperser, or an ultrasonic disperser. A high-speed shearing disperser may be used while setting a revolution to 1,000 to 30,000 rpm, or 5,000 to 20,000 rpm. The dispersing temperature may be 0 to 150° C. (under pressure) or 20 to 80° C.

In the step of dissolving or dispersing constituents of the core particle, such as a binder resin, a colorant, a release agent, etc., in an organic solvent to prepare an oil phase, the constituents are gradually added to the organic solvent while the organic solvent is agitated. Constituent materials which are poorly soluble in the organic solvent (e.g., pigments, release agents, charge controlling agents) may be previously ground into fine particles before being added to the organic solvent.

Colorants, release agents, and charge controlling agents may be previously combined with a resin to be formed into a master batch.

Alternatively, colorants, release agents, and charge controlling agents, optionally along with a dispersing auxiliary agent, may be previously combined with a resin in a wet condition to be formed into a wet master batch.

Constituent materials which are meltable at temperatures below the boiling point of the organic solvent may be previously formed into fine crystal grain by being dissolved in the organic solvent, optionally along with a dispersing auxiliary agent, while the organic solvent is agitated and heated, and subsequently cooled while the organic solvent is agitated or sheared.

After having been dispersed in the organic solvent along with the binder resin by any of the above procedures, the colorant, release agent, and/or charge controlling agent may be further subject to a dispersion treatment by a disperser, such as a bead mill and a disc mill.

In the step of dispersing the oil phase in an aqueous medium to prepare a dispersion liquid containing core droplets, any type of disperser an be used, such as a low-speed shearing disperser, a high-speed shearing disperser, a frictional disperser, a high-pressure jet disperser, or an ultrasonic disperser. A high-speed shearing disperser can produce droplets having a particle diameter of 2 to 20 μm. A high-speed shearing disperser may be used while setting a revolution to 1,000 to 30,000 rpm, or 5,000 to 20,000 rpm. The dispersing time may be 0.1 to 5 minutes when the used disperser is a batch type. When the dispersing time exceeds 5 minutes, the core droplets are excessively dispersed. As a result, undesirable ultrafine droplets may remain dispersed or get aggregated or coarsened. The dispersing temperature may be 0 to 150° C. or 20 to 80° C. When the dispersing temperature exceeds 150° C., molecules of the dispersed materials get active and therefore core droplets get aggregated or coarsened. When the dispersing temperature falls below 0° C., the dispersion liquid gets so viscous that a greater amount of energy is needed, which results in deterioration of manufacturing efficiency.

The aqueous medium may contain a surfactant. Specific examples of usable surfactants include those usable for preparing a dispersion liquid of the organic resin particle described above. For example, disulfonates having a relatively high HLB, which are able to effectively disperse core droplets, can be used. In some embodiments, the content of the surfactant in the aqueous medium is 1 to 10% by weight, 2 to 8% by weight, or 3 to 7% by weight. When the content exceeds 10% by weight, the core droplets get too small or take a reverse micelle structure. As a result, the dispersion liquid gets unstable and the core droplets get coarsened. When the content falls below 1% by weight, it is difficult to stably disperse the core droplets and the core droplets get coarsened.

In the dispersion liquid thus prepared, the core droplets are kept stably dispersed so long as the dispersion liquid is under agitation. While the core droplets are stably dispersed, a dispersion liquid containing fine vinyl resin particles is mixed therein so that the fine vinyl resin particle are brought into adhesion to the core droplets.

The shape of the projections can be controlled by, for example, varying the time period during which the dispersion liquid containing fine vinyl resin particles is mixed in the dispersion liquid containing core droplets, the concentration and/or used amount of the dispersion liquid containing fine vinyl resin particles, the temperature at which the projection is formed, or Dv/Dn (particle size distribution) of the fine vinyl resin particles.

In some embodiments, the dispersion liquid containing fine vinyl resin particles is mixed in the dispersion liquid containing core droplets over a period of 30 seconds or more. When the time period is less than 30 seconds, the dispersion system is so rapidly changed that the fine vinyl resin particles are brought into self-aggregation or nonuniform adhesion to the core droplets. When the time period is too long, for example, exceeds 60 minutes, manufacturing efficiency deteriorates.

The dispersion liquid containing fine vinyl resin particles may be diluted or condensed for adjusting the resin concentration before being mixed with the dispersion liquid containing core droplets. In some embodiments, the concentration of the fine vinyl resin particles in the dispersion liquid is 5 to 30% by weight or 8 to 26% by weight. When the concentration of the fine vinyl resin particles is less than 5% by weight, the concentration of the organic solvent greatly changes upon mixing in the dispersion liquid containing core droplets. As a result, the fine vinyl resin particles are brought into adhesion to the core droplets only slightly, resulting in deterioration of surface coverage of core particle with projections. When the concentration of the fine vinyl resin particles is greater than 30% by weight, the fine vinyl resin particles are non-uniformly dispersed in the mixed dispersion liquid and brought into non-uniform adhesion to the core droplets. The resulting projections may not meet the requirement of standard deviation of the lengths of their long sides.

The surface coverage of core particle with projections can be controlled by varying the amount of the dispersion liquid containing fine vinyl resin particles to be mixed in the dispersion liquid containing core droplets.

The fine vinyl resin particles are brought into adhesion to the core droplets with sufficient strength. This is because the core droplets are flexible enough to form a sufficient contact area between the fine vinyl resin particles. This is also because the fine vinyl resin particles are swelled or dissolved by the organic solvent and thus express adhesive property. Thus, the core droplets should include a certain amount of organic solvent. In some embodiments, the content of the organic solvent in the dispersion liquid containing core droplets is 10 to 70% by weight, 30 to 60% by weight, or 40 to 55% by weight, based on solid contents (e.g., resins, colorants, release agents, charge controlling agents). When the content of the organic solvent exceeds 70% by weight, efficiency and stability in manufacturing core particles deteriorate, for example, the core droplets may self-aggregate. When the content of the organic solvent falls below 10% by weight, the fine vinyl resin particles may be adhered to the core droplets with only a weak adhesion force. In a case in which a desired organic solvent concentration for bringing the fine vinyl resin particles to adhesion to the core droplets is lower than that for forming the core droplets, a part of the organic solvent may be removed after the core droplets have been formed and the residual organic solvent may be completely removed after the fine vinyl resin particles have been brought into adhesion to the core droplets.

In some embodiments, the fine vinyl resin particles are brought into adhesion to the core droplets at a temperature within a range of 10 to 45° C., or 20 to 30° C. When the temperature is higher than 45° C., energy consumption and environmental load undesirably increase in the manufacturing process. Moreover, the fine vinyl resin particles get coarsened and the resulting projections may not meet the requirement of the average length and standard deviation of their long sides. When the temperature is lower than 10° C., the fine vinyl resin particles are brought into adhesion to the core droplets only slightly, resulting in deterioration of surface coverage of core particle with projections.

As an alternative for the above procedure, the fine resin particles can be directly added to the aqueous medium before the core droplets are formed therein.

In some embodiments, the fine resin particles account for 1 to 20% by weight, 3 to 15% by weight, or 5 to 10% by weight, of the toner. When the content of the fine resin particles falls below 1% by weight of the toner, the projections cannot express their effect. When the content of the fine resin particles exceeds 20% by weight of the toner, excessive fine resin particles are weakly adhered to the core particles and the resulting toner cause filming problem. The content of the fine resin particles in the toner can be determined from the composition of raw materials.

As an alternative for the above procedures, the fine resin particles and the core particles can be directly mixed so that they are mechanically adhered to each other.

According to some embodiments, the ratio (Dv/Dn) of the volume average particle diameter (Dv) to the number average particle diameter (Dn) of the fine resin particles is less than 1.25, or less than 1.12, in view of a desired standard deviation of the long sides of the resulting projections.

In some embodiments, the volume average particle diameter (Dv) of the fine resin particles is 50 to 200 nm, 60 to 150 nm, or 70 to 140 nm. When Dv falls below 50 nm or exceeds 200 nm, it may be difficult to uniformly cover the core particles with such fine resin particles.

The organic solvent is removed from the resulting dispersion liquid to obtain core particles by, for example, gradually heating the dispersion liquid under normal or reduced pressures to completely evaporate the organic solvent.

In a case in which a modified polyester having an isocyanate group on its terminal ("polyester prepolymer") in combination with an amine reactive with the modified polyester are included in the constituents, for the purpose of introducing a modified polyester having urethane and/or urea bonds into the toner, the amine may be mixed in either the oil phase before the oil phase is dispersed in the aqueous medium or the aqueous medium. According to some embodiments, the isocyanate group in the polyester prepolymer reacts with the amine over a period of 1 minute to 40 hours, or 1 to 24 hours. The dispersing temperature may be 0 to 150° C. or 20 to 98° C.

The resulting toner particles can be isolated as follows.

First, the resulting dispersion liquid is separated into solid and liquid by means of a centrifugal separator or filter press. The solid, i.e., a toner cake, is redispersed in ion-exchange water at normal temperature to about 40° C. The pH of the dispersion may be controlled by acids and bases, if needed. This procedure is repeated several times until impurities and surfactants are removed from the toner cake. The toner cake is then dried by a flash drier, a circulating drier, a reduced-pressure drier, or a vibrating fluid bed drier. Undesired ultrafine particles may be removed by a centrifugal separator during the drying process, or alternatively, by a classifier after the drying process.

The toner particles may be mixed with heterogeneous particles, such as a charge controlling agent and a fluidizer, upon application of mechanical impulsive force, so that the heterogeneous particles are fixed or fused on the surfaces of the toner particles. Mechanical impulsive force can be applied by, for example, agitating the mixture of toner and heterogeneous particles with blades rotating at a high speed, or accelerating the mixture in a high-speed airflow to allow the toner and heterogeneous particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

According to some embodiments, the toner has a volume average particle diameter within a range of 3 to 9 μm, 4 to 8 μm, or 4 to 7 μm, in view of chargeability. When the volume average particle diameter falls below 3 μm, adhesive force of the toner relatively increases and operability of the toner in an electric field deteriorates. When the volume average particle diameter exceeds 9 μm, image quality, such as thin line reproducibility, deteriorates.

In some embodiments, the ratio of the volume average particle diameter to the number average particle diameter of the toner is 1.25 or less, 1.20 or less, or 1.17 or less. When the ratio exceeds 1.25, particle size distribution of the toner is so wide that the resulting projections may be varied in size. As coarse and ultrafine toner particles are gradually consumed in a developing device, the average particle size of toner particles remaining in the developing device is gradually varied. Although optimal conditions for developing images depend on the average particle size of toner particles, the developing device keeps developing images without changing any condition. As a result, undesirable phenomena occurs, such as insufficient charging of toner, extreme increase or decrease in toner conveyance quantity, toner clogging, and toner spilling.

Particle size distribution of toner can be measured by instruments such as COULTER COUNTER TA-II and COULTER MULTISIZER II (both from Beckman Coulter Inc.) as follows.

First, add 0.1 to 5 ml of a surfactant (e.g., an alkylbenzene sulfonate) to 100 to 150 ml of an electrolyte. The electrolyte is an about 1% NaCl aqueous solution prepared from the first grade sodium chloride, such as a commercial product ISOTON-II (available from Beckman Coulter, Inc.) Next, add 2 to 20 mg of a sample (toner particles) to the electrolyte. Subject the electrolyte, in which the sample is suspended, to a dispersion treatment with an ultrasonic disperser for about 1 to 3 minutes, and subsequently to a measurement of volume and number distributions of the sample with the above instrument having an aperture of 100 μm. Volume average particle diameter (D4) and number average particle diameter (D1) are calculated from the volume and number distributions, respectively, measured above.

The following 13 channels are used so that particles having a particle diameter not less than 2.00 μm but less than 40.30 μm are to be measured: not less than 2.00 μm but less than 2.52 μm; not less than 2.52 μm but less than 3.17 μm; not less than 3.17 μm but less than 4.00 μm; not less than 4.00 μm but less than 5.04 μm; not less than 5.04 μm but less than 6.35 μm; not less than 6.35 μm but less than 8.00 μm; not less than 8.00 μm but less than 10.08 μm; not less than 10.08 μm but less than 12.70 μm; not less than 12.70 μm but less than 16.00 μm; not less than 16.00 μm but less than 20.20 μm; not less than 20.20 μm but less than 25.40 μm; not less than 25.40 μm but less than 32.00 μm; and not less than 32.00 μm but less than 40.30 μm.

In some embodiments, the toner has an average circularity of 0.930 or more, 0.950 or more, or 0.970 or more. When the average circularity falls below 0.930, fluidity of the toner deteriorates and therefore developing and transfer efficiencies also deteriorate.

The average circularity can be measured by a flow-type particle image analyzer FPIA-2000 (from Sysmex Corporation) as follows. Add 0.1 to 0.5 ml of a surfactant (e.g., an alkylbenzene sulfonate) to 100 to 150 ml of water from which solid impurities have been removed, and further add 0.1 to 0.5 g of a sample thereto. Subject the resulting suspension to a dispersion treatment with an ultrasonic disperser for about 1 to 3 minutes. Subject the suspension containing 3,000 to 10,000 particles per micro-liter to a measurement of shape distribution of the sample with above instrument.

A process cartridge according to an embodiment includes at least an electrostatic latent image bearing member adapted to bear an electrostatic latent image and a developing device adapted to develop the electrostatic latent image into a toner image with the toner according to an embodiment.

Figure 2:
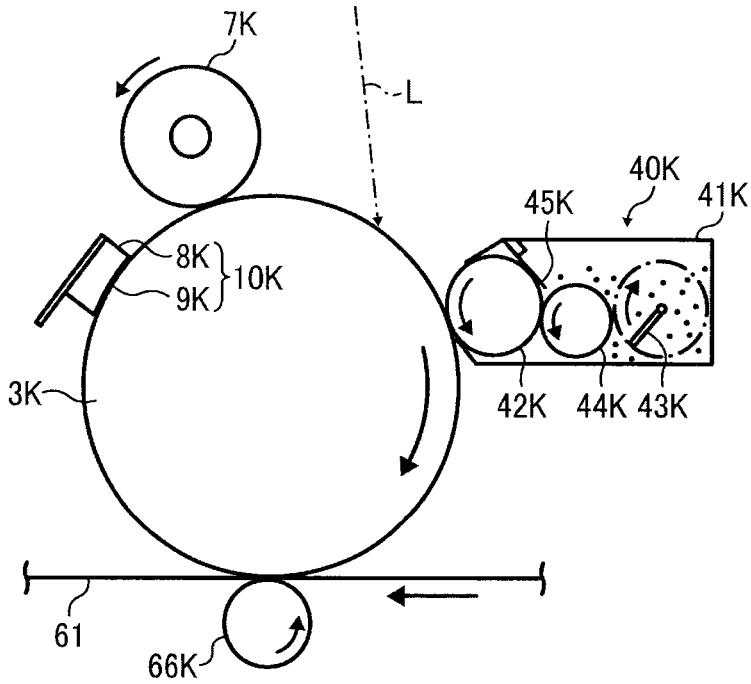
FIG. 2 is a schematic view of a process cartridge according to an embodiment.

FIG. 2 is a schematic view of a process cartridge according to an embodiment.

The process cartridge illustrated in FIG. 2 includes an electrostatic latent image bearing member 3K, an electrostatic latent image bearing member charger 7K, a charging member 10K adapted to recharge residual toner particles remaining on the electrostatic latent image bearing member 3K after image transfer, and a developing device 40K. The process cartridge is detachably attachable to image forming apparatuses such as copiers and printers.

During normal operations, the electrostatic latent image bearing member 3K is driven to rotate at a predetermined peripheral speed. A peripheral surface of the electrostatic latent image bearing member 3K is uniformly charged to a predetermined positive or negative potential by the charger 7K and then irradiated with light L by means of slit exposure or laser beam scanning while the electrostatic latent image bearing member 3K is rotating. As a result, electrostatic latent images are sequentially formed on the peripheral surface of the electrostatic latent image bearing member 3K. The electrostatic latent images are developed into toner images by the developing device 40K. The toner images are sequentially transferred onto a transfer material 61 fed from a paper feed part to a gap between the electrostatic latent image bearing member 3K and a transfer device 66K in synchronization with rotation of the electrostatic latent image bearing member 3K.

The transfer material 61 having the toner image thereon is separated from the peripheral surface of the electrostatic latent image bearing member 3K and introduced into a fixing device so that the toner image is fixed thereon. The transfer material 61 having the fixed toner image is discharged from the image forming apparatus as a copy.

Residual toner particles remaining on the peripheral surface of the electrostatic latent image bearing member 3K after image transfer are recharged by the charging member 10K having an elastic part 8K and a conductive sheet 9K, allowed to pass under the charger 7K, and collected in the developing device 40 to be recycled.

The developing device 40K includes a casing 41K and a developing roller 42K. A part of the peripheral surface of the developing roller 42K is exposed from an aperture provided on the casing 41K.

The shaft of the developing roller 42K is protruding from longitudinal ends of the developing roller 42K. Each end of the shaft is rotatably supported by a bearing.

The casing 41K contains toner particles. An agitator 43K is driven to rotate so as to feed the toner particles from a right side to a left side in FIG. 2.

A toner supply roller 44K is disposed on a left side of the agitator 43K in FIG. 2. The toner supply roller 44K is driven to rotate counterclockwise in FIG. 2. The toner supply roller 44K is comprised of an elastic foam, such as sponge, which can effectively catch toner particles fed from the agitator 43K.

Toner particles caught by the toner supply roller 44K are supplied to the developing roller 42K at a position where the toner supply roller 44K contacts the developing roller 42K.

The toner particles borne on the developing roller 42K are then passed through a position where the developing roller 42K contacts a regulation blade 45K as the developing roller 42K rotates counterclockwise in FIG. 2. At the position, the regulation blade 45 regulates the thickness of the layer of the toner particles while frictionally charging the toner particles. The toner particles are then conveyed to a developing area where the developing roller 42K is facing the electrostatic latent image bearing member 3K.

The charging member 10K is adapted to recharge residual toner particles remaining on the electrostatic latent image bearing member 3K after image transfer. The charging member 10K is conductive. If the charging member 10K is insulative, toner particles may undesirably adhere thereto due to the occurrence of charge up.

According to some embodiments, the charging member 10K is comprised of a sheet of nylon, PTFE, PVDF, or urethane. PTFE and PVD are advantageous in view of toner charging ability.

According to some embodiments, the charging member 10K has a surface resistivity of $10^2$ to $10^8$ Ω/sq and a volume resistivity of $10^1$ to $10^6$ Ω/sq.

The charging member 10K may be in the form of either roller, brush, or sheet. When the charging member 10K is in the form of sheet, toner particles adhered thereto are most easily removable.

According to some embodiments, the charging member 10K is supplied with a voltage of −1.4 to 0 kV.

When the charging member 10K is in the form of sheet, the thickness of the sheet may be 0.05 to 0.5 mm in view of the contact pressure with the electrostatic latent image bearing member 3K.

Additionally, a nip where the sheet is in contact with the electrostatic latent image bearing member 3K has width of 1 to 10 mm in view of the contact time period for charging toner particles.

An image forming apparatus according to an embodiment includes a latent image bearing member, a charger adapted to uniformly charge a surface of the latent image bearing member, an irradiator adapted to emit light to the charged surface of the latent image bearing member based on image information to write an electrostatic latent image thereon, a developing device adapted to develop the electrostatic latent image into a toner image with a toner according to an embodiment, a transfer device adapted to transfer the toner image from the latent image bearing member onto a transfer material, and a fixing device adapted to fix the toner image on the transfer material. The image forming apparatus may optionally include a neutralizer, a cleaner, a recycler, and a controller.

An image forming method according to an embodiment includes the steps of uniformly charging a surface of a latent image bearing member, irradiating the charged surface of the latent image bearing member with light based on image information to write an electrostatic latent image thereon, developing the electrostatic latent image into a toner image with a toner according to an embodiments borne on a developer bearing member, transferring the toner image from the latent image bearing member onto a transfer material, and fixing the toner image on the transfer material. The image forming method may optionally include the steps of neutralizing, cleaning, recycling, and controlling.

An electrostatic latent image is formed by uniformly charging a surface of the latent image bearing member by the charger and irradiating the charged surface with light containing image information.

A toner image is formed by forming a toner layer on a developing roller, serving as the developer bearing member, and bringing the toner layer on the developing roller into contact with the electrostatic latent image on the latent image bearing member.

Toner particles are agitated by an agitator and mechanically supplied to a developer supply member.

The toner particles supplied from the developer supply member and accumulated on the developer bearing member are allowed to pass through a developer layer regulator disposed in contact with the developer bearing member so that a uniform thin layer of the toner particles is formed while the toner particles are frictionally charged.

The electrostatic latent image formed on the latent image bearing member is developed into a toner image by being supplied with the charged toner particles in a developing area.

The toner image is transferred from the latent image bearing member onto a transfer material by charging the latent image bearing member by the transfer device such as a transfer charger.

The toner image is then fixed on the transfer material. Each single-color toner image may be independently fixed on a transfer material, or alternatively, a composite toner image including a plurality of color toner images may be fixed on a transfer material at once.

The fixing device may have functions of heating and pressing.

For example, the fixing device may include a combination of a heating roller and a pressing roller, or a combination of a heating roller, a pressing roller, and an endless belt.

In some embodiments, the heating member is heated to a temperature of 80 to 200° C.

Figure 3:
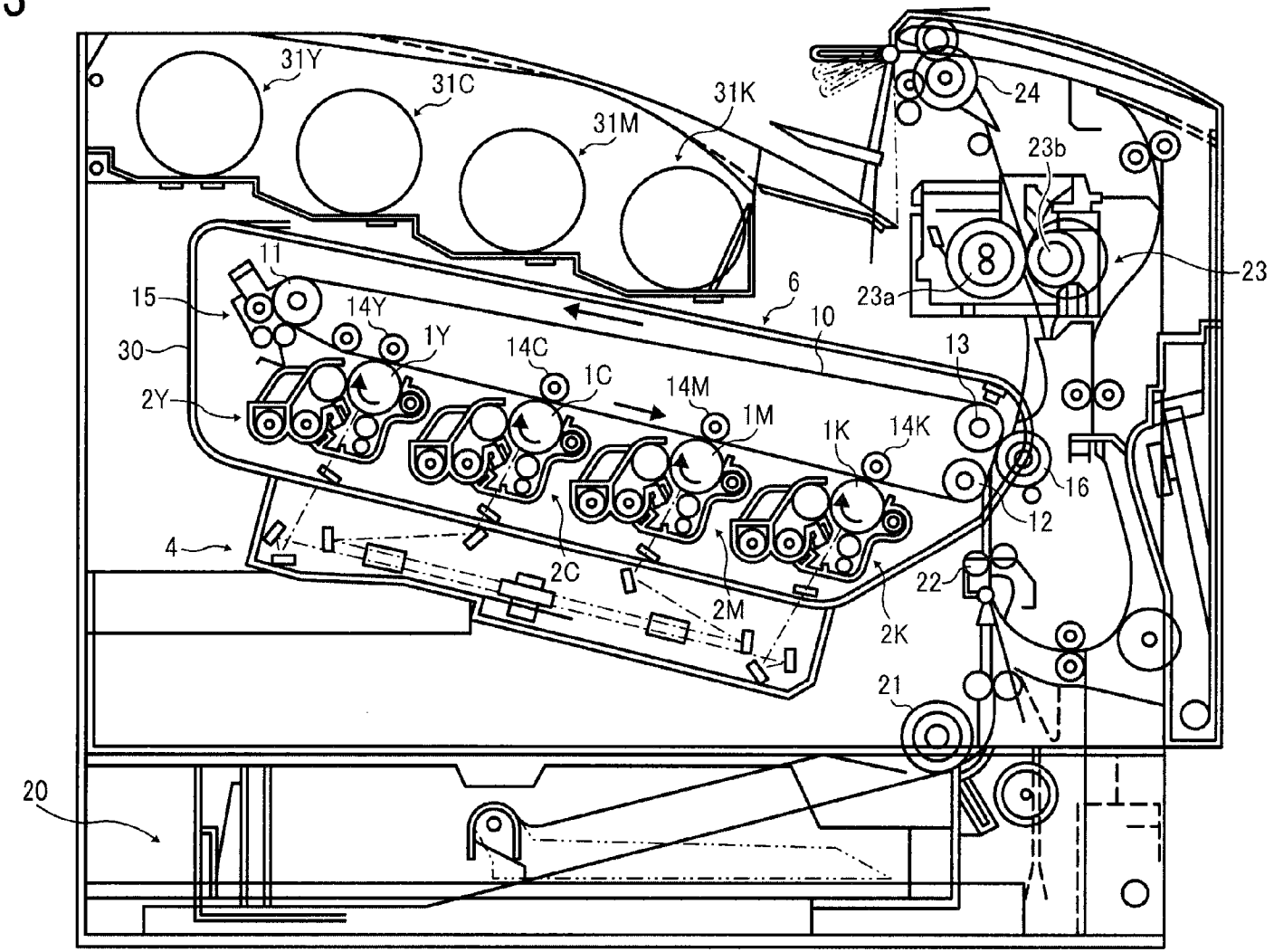
FIG. 3 is a schematic view of an image forming apparatus according to an embodiment.

FIG. 3 is a schematic view of an image forming apparatus according to an embodiment.

The image forming apparatus illustrated in FIG. 3 is an electrophotographic image forming apparatus.

This image forming apparatus forms full-color images with four toners of yellow (Y), cyan (C), magenta (M), and black (K).

This image forming apparatus is a tandem image forming apparatus including multiple latent image bearing members arranged in tandem in the direction of movement of a surface moving member.

In particular, this image forming apparatus includes four photoreceptors 1Y, 1C, 1M, and 1K each serving as the latent image bearing member. The photoreceptors may have either a drum-like shape as illustrated in FIG. 2 or a belt-like shape.

The photoreceptors 1Y, 1C, 1M, and 1K are driven to rotate in the direction indicated by arrows in FIG. 3 while contacting an intermediate transfer belt 10 serving as the surface moving member.

Each of the photoreceptors 1Y, 1C, 1M, and 1K is comprised of, from the innermost side thereof, a relatively thin cylindrical conductive support, a photosensitive layer, and a protective layer. An intermediate layer may be optionally formed between the photosensitive layer and the protective layer.

Figure 4:
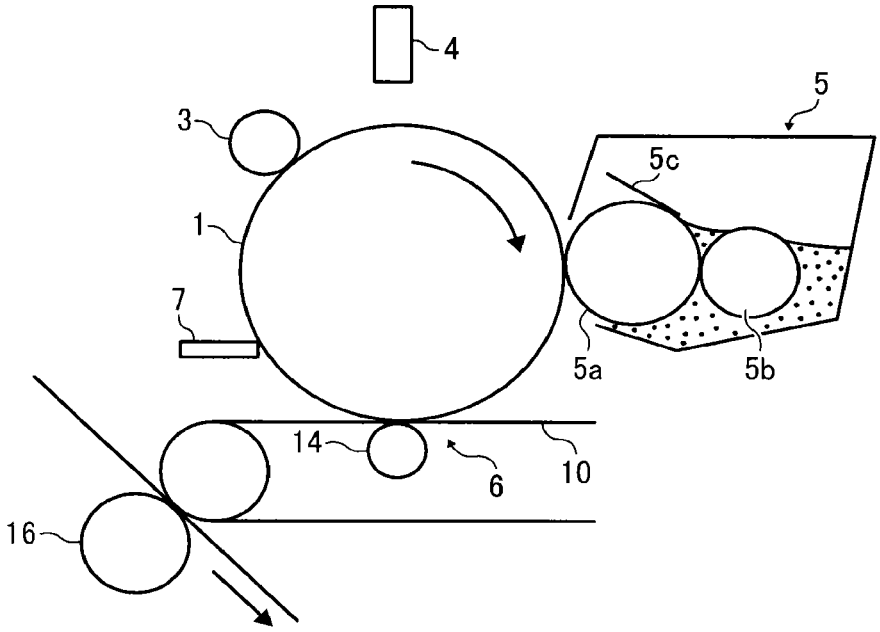
FIG. 4 is a schematic view of an image forming part included in the image forming apparatus illustrated in FIG. 3.

FIG. 4 is a schematic view of each image forming parts 2Y, 2C, 2M, and 2K.

Since the image forming parts 2Y, 2C, 2M, and 2K have the same configuration, additional characters Y, C, M, and K are omitted from the reference numerals in FIG. 4.

Around the photoreceptor 1, a charger 3, a developing device 5, a transfer device 6, and a cleaner 7 are disposed in this order. The transfer device 6 is adapted to transfer a toner image from the photoreceptor 1 onto the intermediate transfer belt 10. The cleaner 7 is adapted to remove residual toner particles remaining on the photoreceptor 1 without being transferred.

Around the photoreceptor 1, a space is provided between the charger 3 and the developing device 5. The space allows light emitted from an irradiator 4 to reach a charged surface of the photoreceptor 1 so that an electrostatic latent image is formed on the photoreceptor 1 based on image information.

The charger 3 charges a surface of the photoreceptor 1 to a negative polarity.

According to an embodiment, the charger 3 is in the form of roller ("charging roller").

The charging roller is brought into contact with or close to a surface of the photoreceptor 1 and supplied with a negative bias for charging the surface of the photoreceptor 1.

For example, the charging roller may be supplied with a direct current charging bias for charging the surface of the photoreceptor 1 to −500 V.

The charging bias may be a direct current bias overlapped with an alternating current bias.

The charger 3 may be equipped with a cleaning brush that cleans the surface of the charging roller.

Each axial end part of the charging roller may be wrapped around with a thin tape and brought into contact with the surface of the photoreceptor 1.

In this case, the surface of the charging roller is brought close to the surface of the photoreceptor 1 while forming a gap therebetween. The gap has a distance equivalent to the thickness of the tape. Upon application of a charging bias to the charging roller, electric discharge occurs in the gap. As a result, the surface of the photoreceptor 1 is charged.

The charged surface of the photoreceptor 1 is then irradiated with light emitted from the irradiator 4. As a result, an electrostatic latent image is formed on the photoreceptor 1.

The irradiator 4 writes an electrostatic latent image on the photoreceptor 1 based on image information of each color.

The irradiator 4 may employ either a laser method or another method using an LED array and an imaging device.

Toner particles are supplied to the developing device 5 from any of toner bottles 31Y, 31C, 31M, and 31K. A developer supply roller 5*b* feeds the toner particles onto a developing roller 5*a*.

The developing roller 5*a* conveys the toner particles to a developing area where the developing roller 5*a* is facing the photoreceptor 1.

In the developing area, the surface of the developing roller 5*a* moves in the same direction as the surface of the photoreceptor 1 moves at a higher linear speed than the photoreceptor 1.

Toner particles carried on the developing roller 5*a* are supplied to the surface of the photoreceptor 1 while the developing roller 5*a* is abrasively contacting the surface of the photoreceptor 1. The developing roller 5*a* is supplied with a developing bias of −300 V from a power source. As a result, a developing electric field is formed in the developing area.

Toner particles carried on the developing roller 5*a* are electrostatically attracted to the electrostatic latent image on the photoreceptor 1.

Thus, the electrostatic latent image on the photoreceptor 1 is developed into a toner image.

In the transfer device 6, the intermediate transfer belt 10 is stretched across three support rollers 11, 12, and 13 and is endlessly movable in a direction indicated by arrow in FIG. 3.

Toner images formed on the photoreceptors 1Y, 1C, 1M, and 1K are electrostatically transferred onto the intermediate transfer belt 10 in sequence and superimposed on one another.

The transfer of toner images are performed by respective primary transfer rollers 14Y, 14C, 14M, and 14K, which cause less toner scattering than transfer chargers.

The primary transfer rollers 14Y, 14C, 14M, and 14K are disposed facing the photoreceptors 1Y, 1C, 1M, and 1K, respectively, with the intermediate transfer belt 10 therebetween.

Thus, primary transfer nips are formed between the photoreceptors 1Y, 1C, 1M, and 1K and each portions of the intermediate transfer belt 10 pressed by the primary transfer rollers 14Y, 14C, 14M, and 14K, respectively.

Toner images formed on the photoreceptors 1Y, 1C, 1M, and 1K are transferred onto the intermediate transfer belt 10 by supplying a positive bias to each of the primary transfer rollers 14Y, 14C, 14M, and 14K.

Thus, a transfer electric field is formed in each primary transfer nip. Each toner image formed on the photoreceptor 1Y, 1C, 1M, or 1K is electrostatically attracted to the intermediate transfer belt 10.

A belt cleaner 15 is disposed adjacent to the intermediate transfer belt 10.

The belt cleaner 15 collects residual toner particles remaining on the intermediate transfer belt 10 with a fur brush and a cleaning blade.

The collected toner particles are fed from the belt cleaner 15 to a waste toner tank.

A secondary transfer roller 16 is in contact with the intermediate transfer belt 10 at a position where the support roller 13 presses against the intermediate transfer belt 10.

Thus, a secondary transfer nip is formed between the secondary transfer roller 16 and the intermediate transfer belt 10. A sheet of transfer paper (hereinafter "a transfer paper") is timely fed to the secondary transfer nip.

Sheets of transfer paper are stored in a paper feed cassette 20 disposed below the irradiator 4 in FIG. 3. A paper feed roller 21 and a pair of registration rollers 22 feed sheets to the secondary transfer nip.

The toner images superimposed on one another on the intermediate transfer belt 10 are transferred onto a transfer paper in the secondary transfer nip at once.

At the secondary transfer, the secondary transfer roller 16 is supplied with a positive bias so that a transfer electric field is formed. The toner images are transferred from the intermediate transfer belt 10 onto a transfer paper by action of the transfer electric field.

A heat fixing device 23 is disposed downstream from the secondary transfer nip relative to the direction of conveyance of the transfer paper.

The heat fixing device 23 has a heating roller 23*a* containing a heater and a pressing roller 23*b*.

The transfer paper having passed through the secondary transfer nip is sandwiched by the heating and pressing rollers 23*a* and 23*b* and received heat and pressure therefrom. Thus, the toner particles on the transfer paper are melted and fixed thereon. A discharge roller 24 discharges the transfer paper having the fixed toner image onto a discharge tray.

A part of the developing roller 5*a*, serving as the developer bearing member, is exposed from an aperture provided on the casing of the developing device 5.

In the present embodiment, a one-component developer comprising toner particles and no carrier particles is used.

The developing device 5 contains toner particles supplied from any of the toner bottles 31Y, 31C, 31M, and 31K.

The toner bottles 31Y, 31C, 31M, and 31K are independently detachable from the image forming apparatus.

Therefore, there is no need to replace all the toner bottles 31Y, 31C, 31M, and 31K when only one of them gets out of toner. User can keep using the remaining toner bottles without unnecessary expense.

Figure 5:
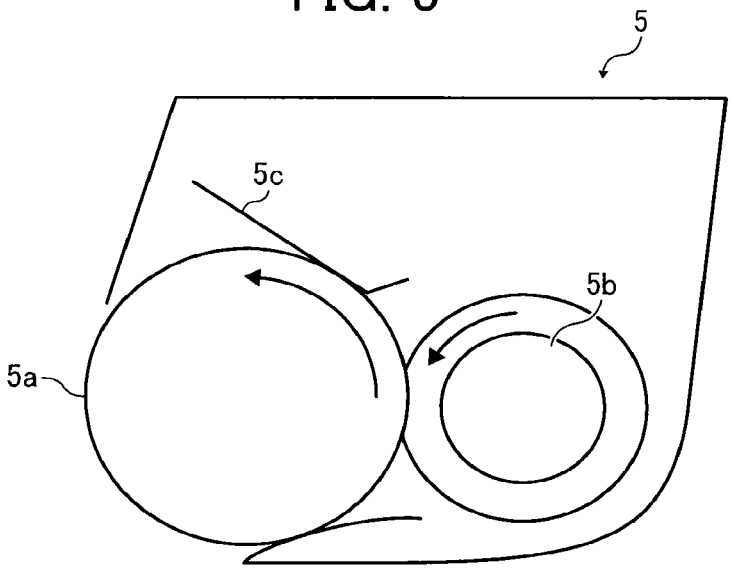
FIG. 5 is a schematic view of a developing device included in the image forming part illustrated in FIG. 4.

FIG. 5 is a schematic view of the developing device 5 illustrated in FIG. 4. Toner particles are fed to a nip portion formed between the developing roller 5*a* and the developer supply roller 5*b* while being agitated by the developer supply roller 5*b*. In the nip portion, the developer supply roller 5*b* and the developing roller 5*a* move in opposite directions.

A regulation blade 5*c* is disposed in contact with the developing roller 5*a*. The regulation blade 5*c* regulates the amount of toner particles carried on the developing roller 5*a* and forms a thin layer of the toner particles.

Toner particles are frictionally charged in the nip portion between the developer supply roller 5*b* and the developing roller 5*a* as well as in the gap between the regulation blade 5*c* and the developing roller 5*a*.

Figure 6:
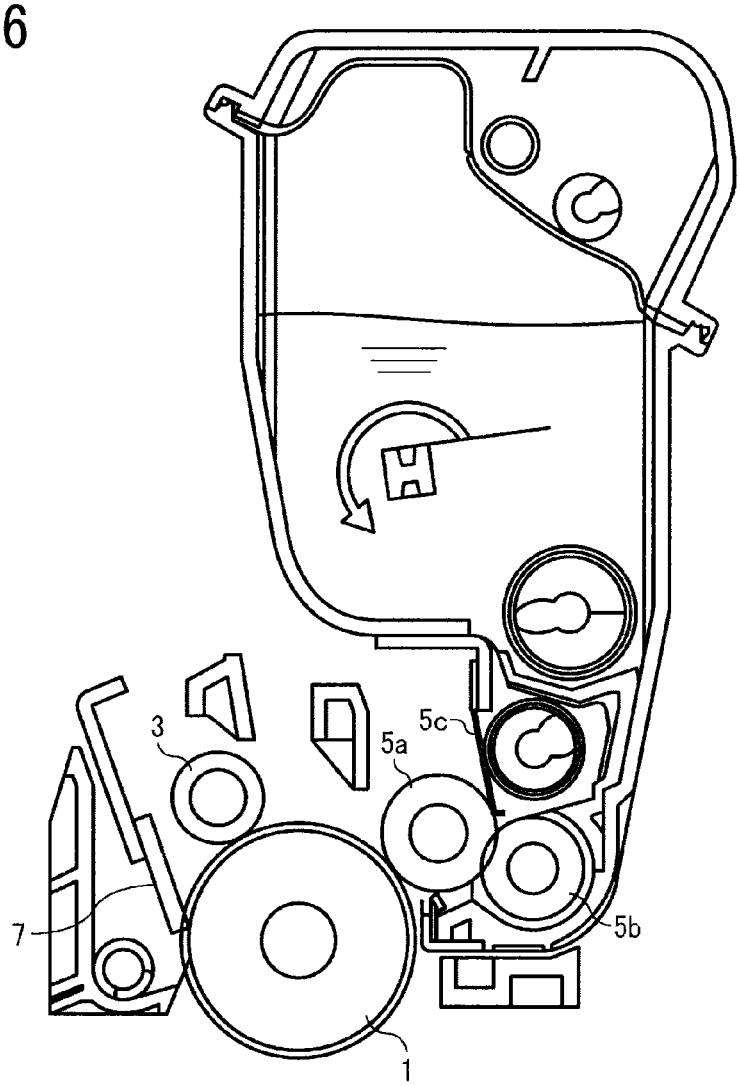
FIG. 6 is a schematic view of a process cartridge according to an embodiment.

FIG. 6 is a schematic view of a process cartridge according to an embodiment.

The process cartridge is detachably attachable to image forming apparatuses such as copiers and printers.

The process cartridge illustrated in FIG. 6 integrally supports an electrostatic latent image bearing member, an electrostatic latent image charger, and the developing device illustrated in FIG. 5.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Toners prepared in Examples can be used for either one-component developers or two-component developers.

Measurement of Lengths of Long Sides of Projections and Surface Coverage

The lengths of the long sides of projections and surface coverage of toner with the projections are determined from a SEM (scanning electron microscopy) image of toner.

Figure 7:
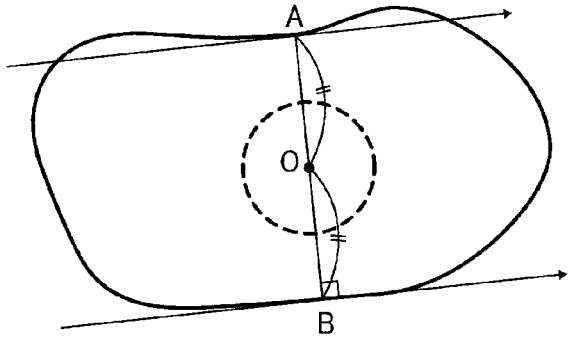
FIG. 7 is a schematic view of a SEM image of a toner particle according to an embodiment.

FIG. 7 is an example of a SEM image of a toner particle. Measurement procedures are described below with reference to FIG. 7.

Surface Coverage of Toner

Draw two parallel lines each tangent to a toner particle at points A and B with the distance between the points A and B at the minimum.

Determine an area of a circle drawn with the midpoint O of the line segment AB at its center. Determine a total area of projections included within the circle. Calculate a surface coverage by dividing the total area of the projections by the area of the circle.

Subject 100 randomly-selected toner particles to the above procedure and average the calculated values.

Lengths of Long Sides of Projections

Subject 100 randomly-selected toner particles to a measurement of the length of the long side of one projection and average the calculated values. The area and length of each projection is measured with particle size distribution measurement analysis software Mac-View from Mountech Co., Ltd.

Specifically, draw a line passing the gravity center O' of the projection and intersecting the outer periphery of the projection at points a and b with the distance between the points a and b at the maximum. The line segment ab is regarded as the long side of the projection.

Measurement of Particle Size Distribution

Particle size distribution of toner is measured by instruments such as COULTER COUNTER TA-II or COULTER MULTISIZER II (both from Beckman Coulter Inc.) as follows.

First, add 0.1 to 5 ml of a surfactant (e.g., an alkylbenzene sulfonate) to 100 to 150 ml of an electrolyte. The electrolyte is an about 1% NaCl aqueous solution prepared from the first grade sodium chloride, such as a commercial product ISOTON-II (available from Beckman Coulter, Inc.). Next, add 2 to 20 mg of a sample (toner particles) to the electrolyte. Subject the electrolyte, in which the sample is suspended, to a dispersion treatment with an ultrasonic disperser for about 1 to 3 minutes, and subsequently to a measurement of volume and number distributions of the sample with the above instrument having an aperture of 100 μm. Volume average particle diameter (Dv) and number average particle diameter (Dn) are calculated from the volume and number distributions, respectively, measured above.

The following 13 channels are used so that particles having a particle diameter not less than 2.00 μm but less than 40.30 μm are to be measured: not less than 2.00 μm but less than 2.52 μm; not less than 2.52 μm but less than 3.17 μm; not less than 3.17 μm but less than 4.00 μm; not less than 4.00 μm but less than 5.04 μm; not less than 5.04 μm but less than 6.35 μm; not less than 6.35 μm but less than 8.00 μm; not less than 8.00 μm but less than 10.08 μm; not less than 10.08 μm but less than 12.70 μm; not less than 12.70 μm but less than 16.00 μm; not less than 16.00 μm but less than 20.20 μm; not less than 20.20 μm but less than 25.40 μm; not less than 25.40 μm but less than 32.00 μm; and not less than 32.00 μm but less than 40.30 μm.

Measurement of Average Circularity

The shapes of toner particles are determined by passing a suspension liquid containing toner particles through a detecting band in an imaging area on a flat plate, optically detecting images of the toner particles with a CCD camera, and analyzing the images. Specifically, the average circularity is determined by dividing the peripheral length of a circle having the same area as a projected image of a toner particle detected as above by the peripheral length of the projected image.

The average circularity is measured by a flow-type particle image analyzer FPIA-2000 (from Sysmex Corporation) as follows. Add 0.1 to 0.5 ml of a surfactant (e.g., an alkylbenzene sulfonate) to 100 to 150 ml of water from which solid impurities have been removed, and further add 0.1 to 0.5 g of a sample thereto. Subject the resulting suspension to a dispersion treatment with an ultrasonic disperser for about 1 to 3 minutes. Subject the suspension containing 3,000 to 10,000 particles per micro-liter to a measurement of shape distribution of the sample with above instrument.

Measurement of Volume Average Particle Diameter of Fine Resin Particles

The volume average particle diameter of fine resin particles is measured by a Nanotrac Wave Particle Analyzer UPA-EX150 with Dynamic Light Scattering Technology (from Nikkiso Co., Ltd.). Specifically, a dispersion liquid containing fine resin particles having a predetermined concentration is subjected to a measurement. A solvent of the dispersion liquid alone is previously subjected to the measurement as a background. Fine resin particles having a volume average particle diameter of several tens nm to several μm are to be measured by the above procedure.

Measurement of Molecular Weight

Molecular weights of resins, such as polyester and vinyl resins, are measured by GPC (gel permeation chromatography) under the following conditions.

Instrument: HLC-8220GPC (from Tosoh Corporation)

Columns: TSKgel SuperHZM-M×3

Measuring temperature: 40° C.

Solvent: THF (Tetrahydrofuran)

Flow rate: 0.35 ml/min

Sample concentration: 0.05-0.6%

Injection amount: 0.01 ml

The weight average molecular weight (Mw) is determined from a molecular weight distribution curve thus obtained with reference to a calibration curve complied with monodisperse polystyrene standard samples. Each of the used monodisperse polystyrene standard samples has a molecular weight of 5.8×100, 1.085×10,000, 5.95×10,000, 3.2×100,000, 2.56×1,000,000, 2.93×1,000, 2.85×10,000, 1.48×100,000, 8.417×100,000, and 7.5×1,000,000.

Measurement of Glass Transition Temperature and Endothermic Quantity

Glass transition temperature of a resin is measured by a differential scanning calorimeter (e.g., DSC-6220R from Seiko Instruments Inc.) as follows. Heat a sample from room temperature to 150° C. at a heating rate of 10° C./min, allow it to stand for 10 minutes at 150° C., cool it to room temperature, allow it to stand for 10 minutes at room temperature, and reheat it to 150° C. at a heating rate of 10° C./min, thus obtaining an endothermic curve. Glass transition temperature is determined from a middle point on the endothermic curve between two baselines drawn at above and below that point.

Endothermic quantity and melting point of release agents, crystalline resins, and toners can also be determined from the endothermic curve. Endothermic quantity is determined by calculating a peak area of an endothermic peak. Generally, a release agent is meltable at a lower temperature than a temperature at which a toner is to be fixed. The heat of melting of the release agent is observed as an endothermic peak in the endothermic curve. Some release agents generate heat of transition due to the occurrence of phase transition in a solid phase. In such cases, the total heat of melting and transition is used for calculating endothermic quantity. Melting point is determined from a temperature at which an endothermic peak has a local minimum value.

Toners are subjected to a measurement of melting point before being mixed with an external additive.

The amount of a crystalline resin included in a toner is determined as follows. Heat a toner in an amount of about 5 mg from −20° C. to 150° C. at an average heating rate of 1° C./min and a temperature amplitude of 0.5° C./60 sec by a differential scanning calorimeter (e.g., temperature-modulated differential scanning calorimeter Q200 from TA Instruments), thus measuring the amount of heat of melting. The amount of heat of melting thus measured is converted into the amount of a crystalline resin with reference to a calibration curve or the heat of melting determined from a single body of the crystalline resin.

Evaluation of Chargeability (Background Contamination)

Contain a toner in a cartridge for black toner in a printer IPSIO SP C220 (from Ricoh Co., Ltd.). Print a 5% chart, i.e., a test chart No. 8 issued by The Imaging Society of Japan, on a sheet of white paper. Visually observe the white paper and photoreceptor to determine whether toner particles have soiled them or not.

A: No toner particle is observed on either the white paper or the photoreceptor.

B: No toner particle is observed on the white paper but a slight amount of toner particles are observed on the photoreceptor viewed at an angle.

C: A slight amount of toner particles are observed on the white paper viewed at an angle.

D: An amount of toner particles are clearly observed on the white paper.

Evaluation of Resistance to Sticking

Observe the image printed above to determine whether undesired white lines are generated or not. Observe the regulation blade, having been in contact with the developing roller, to determine whether toner particles are stuck thereto or not.

A: No white line is observed in the image. No toner particle is observed to be stuck to the regulation blade.

B: No white line is observed in the image. A slight amount of toner particles are observed to be stuck to the regulation blade but easily releasable when being scratched slightly.

C: White lines are slightly observed in the image. A slight amount of toner particles are observed to be stuck to the regulation blade and not releasable even when being scratched slightly.

D: White lines are observed in the image. An amount of toner particles are observed to be stuck to the regulation blade.

Evaluation of Low-Temperature Fixability

Contain a toner in a printer IPSIO SP C220 (from Ricoh Co., Ltd.) which has been modified. Produce an unfixed solid image having a size of 50 mm×50 mm and toner particles in an amount of 10 g/m$^2$ on 19 sheets of paper TYPE 6200Y (from Ricoh Co., Ltd.).

Pass each of the unfixed solid images through a modified fixing unit at a system speed of 280 mm/sec to fix each solid image on each sheet while varying the fixing temperature to 120° C. to 200° C. at an interval of 5° C. Fold each sheet with the fixed solid image inside and reopen it. Slightly rub the fixed solid image with an eraser. The minimum fixable temperature is defined as the lowest temperature at which the fold line does not disappear.

A: The minimum fixable temperature is less than 100° C.

B: The minimum fixable temperature is not less than 100° C. but less than 110° C.

C: The minimum fixable temperature is not less than 110° C. but less than 120° C.

D: The minimum fixable temperature is not less than 120° C.

Evaluation of Heat-Resistant Storage Stability

Contain a toner in an amount of 25 g in a 50-ml glass vial, allow it to stand for 24 hours in a constant-temperature chamber at 55° C., and cool it to 24° C. Subject the toner to a penetration test according to JIS K2235-1991 to measure penetration. The greater the penetration, the better the heat-resistant storage stability. A toner with the penetration less than 10 mm may cause a problem in practical use. Penetration is graded into the following levels.

A: Penetration is not less than 20 mm.

B: Penetration is not less than 15 mm and less than 20 mm.

C: Penetration is not less than 10 mm and less than 15 mm.

D: Penetration is less than 10 mm.

Preparation of Crystalline Polyester Resin C-1

Charge a reaction vessel equipped with a condenser, a stirrer, and a nitrogen inlet pipe with 353 parts of 1,10-decanediol, 289 parts of adipic acid, and 0.8 parts of dibutyltin oxide. Subject the mixture to a reaction for 6 hours at 180° C.

under normal pressure. Further subject the mixture to a reaction for 4 hours under reduced pressure of 10 to 15 mmHg. Thus, a crystalline polyester resin C-1 is prepared. The crystalline polyester resin C-1 has a number average molecular weight of 14,000, a weight average molecular weight of 33,000, and a melting point of 65° C. The endothermic quantity gets maximum at the melting point.

Preparation of Crystalline Polyester Resin C-2

Charge a reaction vessel equipped with a condenser, a stirrer, and a nitrogen inlet pipe with 160 parts of 1,9-nonanediol, 208 parts of 1,10-dodecanedioic acid, 5.92 parts of dimethyl 5-sulfoisophthalate sodium salt, 16.7 parts of 5-t-butylisophthalic acid, and 0.4 parts of dibutyltin oxide. Subject the mixture to a reaction for 6.5 hours at 180° C. under normal pressure. Further subject the mixture to a reaction for 4 hours at 220° C. under reduced pressure of 10 to 15 mmHg. Thus, a crystalline polyester resin C-2 is prepared. The crystalline polyester resin C-2 has a number average molecular weight of 4,200, a weight average molecular weight of 15,000, and a melting point of 72° C. The endothermic quantity gets maximum at the melting point.

Preparation of Crystalline Polyester Resin C-3

Charge a reaction vessel equipped with a condenser, a stirrer, and a nitrogen inlet pipe with 124 parts of ethylene glycol, 139 parts of adipic acid, 2.96 parts of dimethyl 5-sulfoisophthalate sodium salt, 7.78 parts of 5-t-butylisophthalic acid, and 0.4 parts of dibutyltin oxide. Subject the mixture to a reaction for 5 hours at 180° C. under normal pressure. After removing the excessive ethylene glycol by distillation under reduced pressure, subject the mixture to a reaction for 2.5 hours at 220° C. under reduced pressure of 10 to 15 mmHg. Thus, a crystalline polyester resin C-3 is prepared. The crystalline polyester resin C-3 has a number average molecular weight of 3,400, a weight average molecular weight of 10,000, and a melting point of 47° C. The endothermic quantity gets maximum at the melting point.

Preparation of Crystalline Polyester Resin C-4

Charge a reaction vessel equipped with a condenser, a stirrer, and a nitrogen inlet pipe with 353 parts of 1,10-decanediol, 289 parts of adipic acid, and 0.8 parts of dibutyltin oxide. Subject the mixture to a reaction for 8 hours at 180° C. under normal pressure. Further subject the mixture to a reaction for 6 hours under reduced pressure of 10 to 15 mmHg. Thus, a crystalline polyester resin C-4 is prepared. The crystalline polyester resin C-4 has a number average molecular weight of 18,000, a weight average molecular weight of 53,000, and a melting point of 67° C. The endothermic quantity gets maximum at the melting point.

Preparation of Crystalline Polyester Resin C-5

Charge a reaction vessel equipped with a condenser, a stirrer, and a nitrogen inlet pipe with 174 parts of 1,10-decanediol, 289 parts of adipic acid, and 0.4 parts of dibutyltin oxide. Subject the mixture to a reaction for 5 hours at 180° C. under normal pressure. Further subject the mixture to a reaction for 2 hours under reduced pressure of 10 to 15 mmHg. Thus, a crystalline polyester resin C-5 is prepared. The crystalline polyester resin C-5 has a number average molecular weight of 3,600, a weight average molecular weight of 12,000, and a melting point of 60° C. The endothermic quantity gets maximum at the melting point.

Preparation of Modified Polyester Resin D-1

Charge a reaction vessel equipped with a condenser, a stirrer, and a nitrogen inlet pipe with 241 parts of sebacic acid, 31 parts of adipic acid, 164 parts of 1,4-butanediol, and 0.75 parts of dihydroxybis(triethanolaminato) titanium as a condensation catalyst. Subject the mixture to a reaction for 8 hours at 180° C. under nitrogen gas flow while removing the produced water. Gradually heat the mixture to 225° C. and subject it to a reaction for 4 hours under nitrogen gas flow while removing the produced water and 1,4-butanediol. Further subject the mixture to a reaction under reduced pressure of 5 to 20 mmHg until the weight average molecular weight reaches 18,000.

Charge another reaction vessel equipped with a condenser, a stirrer, and a nitrogen inlet pipe with 218 parts of the above-prepared crystalline resin, 250 parts of ethyl acetate, and 82 parts of hexamethylene diisocyanate (HDI). Subject the mixture to a reaction for 5 hours at 80° C. under nitrogen gas flow. Remove the ethyl acetate under reduced pressure. Thus, a modified polyester resin D-1 (i.e., a polyester/polyurethane resin) is prepared. The modified polyester resin has a weight average molecular weight of about 52,000 and a melting point of 65° C. The endothermic quantity gets maximum at the melting point.

Preparation of Crystalline Polyurea Resin E-1

Charge a reaction vessel equipped with a condenser, a stirrer, and a nitrogen inlet pipe with 79 parts (0.90 mol) of 1,4-butanediamine, 116 parts (1.00 mol) of 1,6-hexanediamine, and 600 parts of methyl ethyl ketone (MEK), and agitate the mixture. Further add 475 parts (1.90 mol) of 4,4'-diphenylmethane diisocyanate to the vessel and subject the mixture to a reaction for 4 hours at 60° C. under nitrogen gas flow. Remove the MEK under reduced pressure. Thus, a crystalline polyurea resin E-1 is prepared. The crystalline polyurea resin E-1 has a weight average molecular weight of 46,000 and a melting point of 62° C. The endothermic quantity gets maximum at the melting point.

Preparation of Urethane-Modified Crystalline Polyester Resin F-1

Charge a reaction vessel equipped with a condenser, a stirrer, and a nitrogen inlet pipe with 202 parts (1.00 mol) of sebacic acid, 189 parts (1.60 mol) of 1,6-hexanediol, and 0.5 parts of dibutyltin oxide as a condensation catalyst. Subject the mixture to a reaction for 8 hours at 180° C. under nitrogen gas flow while removing the produced water. Gradually heat the mixture to 220° C. and subject it to a reaction for 4 hours under nitrogen gas flow while removing the produced water and 1,6-hexanediol. Further subject the mixture to a reaction under reduced pressure of 5 to 20 mmHg until the weight average molecular weight reaches 7,000. Thus, a crystalline polyester resin F'-1 is prepared. The crystalline polyester resin F'-1 has a weight average molecular weight of 7,000.

Charge another reaction vessel equipped with a condenser, a stirrer, and a nitrogen inlet pipe with the above-prepared crystalline polyester resin F'-1, 300 parts of ethyl acetate, and 38 parts (0.15 mol) of 4,4'-diphenylmethane diisocyanate (MDI). Subject the mixture to a reaction for 5 hours at 80° C. under nitrogen gas flow. Remove the ethyl acetate under reduced pressure. Thus, a urethane-modified crystalline polyester resin F-1 is prepared. The urethane-modified crystalline polyester resin F-1 has a weight average molecular weight of 15,000 and a melting point of 65° C. The endothermic quantity gets maximum at the melting point.

Preparation of Crystalline Resin Precursor G-1

Charge a reaction vessel equipped with a condenser, a stirrer, and a nitrogen inlet pipe with 202 parts (1.00 mol) of sebacic acid, 122 parts (1.03 mol) of 1,6-hexanediol, and 0.5 parts of dihydroxybis(triethanolaminato) titanium as a condensation catalyst. Subject the mixture to a reaction for 8 hours at 180° C. under nitrogen gas flow while removing the produced water. Gradually heat the mixture to 220° C. and subject it to a reaction for 4 hours under nitrogen gas flow while removing the produced water and 1,6-hexanediol. Further subject the mixture to a reaction under reduced pressure of 5 to 20 mmHg until the weight average molecular weight reaches 25,000.

Charge another reaction vessel equipped with a condenser, a stirrer, and a nitrogen inlet pipe with the above-prepared crystalline resin, 300 parts of ethyl acetate, and 27 parts (0.16 mol) of hexamethylene diisocyanate (HDI). Subject the mixture to a reaction for 5 hours at 80° C. under nitrogen gas flow. Thus, a 50% ethyl acetate solution of a crystalline resin precursor G-1 having an isocyanate group on its terminal is prepared.

Mix 10 parts of the ethyl acetate solution of the crystalline resin precursor G-1 with 10 parts of tetrahydrofuran (THF) and 1 part of dibutylamine. Agitate the mixture for 2 hours. As a result of a GPC measurement of the ethyl acetate solution, the crystalline resin precursor G-1 has a weight average molecular weight of 53,000. As a result of a DSC measurement, the crystalline resin precursor G-1 has a melting point of 57° C. The endothermic quantity gets maximum at the melting point.

Preparation of Amorphous Polyester Resin A-1

Charge a reaction vessel equipped with a condenser, a stirrer, and a nitrogen inlet pipe with 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide. Subject the mixture to a reaction for 8 hours at 230° C. under normal pressure. Further subject the mixture to a reaction for 5 hours under reduced pressure of 10 to 15 mmHg. After adding 44 parts of trimellitic anhydride to the vessel, further subject the mixture to a reaction for 2 hours at 180° C. under normal pressure. Thus, an amorphous polyester resin A-1 is prepared. The amorphous polyester resin A-1 has a number average molecular weight of 2,500, a weight average molecular weight of 6,700, a glass transition temperature of 43° C., and an acid value of 25 mgKOH/g.

Properties of the above-prepared resins are shown in Table 1.

TABLE 1

| Resin | Composition (parts by weight) | | | | | | | | Properties | |
|---|---|---|---|---|---|---|---|---|---|---|
| | | | | | | | | | Tm1 (° C.) | Mw |
| C-1 | Adipic acid | 289 | — | — | — | — | 1,10-Decanediol | 353 | 65 | 33,000 |
| C-2 | 1,10-Dodecanedioic acid | 208.3 | Dimethyl 5-sulfoisophthalate sodium salt | 5.92 | 5-t-Butylisophthalic acid | 16.7 | 1,9-Nonanediol | 160.25 | 72 | 15,000 |
| C-3 | Adipic acid | 139 | Dimethyl 5-sulfoisophthalate sodium salt | 2.96 | 5-t-Butylisophthalic acid | 7.78 | Ethylene glycol | 124 | 47 | 10,000 |
| C-4 | Adipic acid | 289 | — | — | — | — | 1,10-Decanediol | 353 | 67 | 53,000 |
| C-5 | Adipic acid | 289 | — | — | — | — | 1,10-Decanediol | 174 | 60 | 12,000 |
| D-1 | Sebacic acid | 241 | Adipic acid | 31 | 1,4-Butanediol | 164 | HDI | 82 | 62 | 52,000 |
| A-1 | Adipic acid | 46 | Terephthalic acid | 208 | Ethylene oxide 2 mol adduct of bisphenol A | 229 | Propylene oxide 3 mol adduct of bisphenol A | 529 | 43 (Tg) | 6,700 |
| E-1 | 1,4-Butanediamine | 79 | 1,6-Hexanediamine | 116 | MDI | 475 | — | — | 62 | 46,000 |
| F-1 | Sebacic acid | 202 | 1,6-Hexanediol | 189 | MDI | 38 | — | — | 65 | 15,000 |
| G-1 | Sebacic acid | 202 | 1,6-Hexanediol | 122 | HDI | 27 | Dibutylamine | 1 | 57 | 53,000 |

Preparation of Colorant Dispersion Liquid

Charge a beaker with 20 parts of a copper phthalocyanine, 4 parts of a colorant dispersant (SOLSPERSE 28000 from Avecia), and 76 parts of ethyl acetate. Subject the mixture to a dispersion treatment with a bead mill to finely disperse the copper phthalocyanine. Thus, a colorant dispersion liquid 1 is prepared. The colorant particles dispersed in the colorant dispersion liquid 1 has a volume average particle diameter of 0.3 μm measured by particle analyzer LA-920 from Horiba, Ltd.

Preparation of Release Agent Dispersant 1

Charge an autoclave reaction vessel equipped with a thermometer and a stirrer with 454 parts of xylene and 150 parts of a low-molecular-weight polyethylene (SANWAX LEL-400 from Sanyo Chemical Industries, Ltd., having a softening point of 128° C.). After replacing the air in the vessel with nitrogen gas, heat the mixture to 170° C. to be melted. Drop a mixture liquid of 595 parts of styrene, 255 parts of methyl methacrylate, 34 parts of di-t-butylperoxyhexahydroterephthalate, and 119 parts of xylene in the vessel over a period of 3 hours at 170° C. Subject the mixture to a polymerization and keep it at that temperature for 30 minutes. Remove the solvent thereafter. Thus, a release agent dispersant 1 is prepared. The release agent dispersant 1 has a number average molecular weight of 1,872, a weight average molecular weight of 5,194, and a glass transition temperature of 56.9° C.

Preparation of Wax Dispersion Liquid

Charge a reaction vessel equipped with a thermometer and a stirrer with 10 parts of a paraffin wax (having a melting point of 73° C.), 1 part of the release agent dispersant 1, and 33 parts of ethyl acetate. Heat the mixture to 78° C. so that the wax is dissolved in the ethyl acetate. Cool the resulting solution to 30° C. over a period of 1 hour so that the wax is crystallized into the form of fine particles. Subject the solution to a wet pulverization treatment with a ULTRA VISCO MILL (from Aimex Co., Ltd.). Thus, a wax dispersion liquid 1 is prepared.

Preparation of Fine Vinyl Resin Particle Dispersion Liquid V-1

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.6 parts of potassium persulfate are dissolved in 104 parts of ion-exchange water to the vessel. After 15 minutes, drop a monomer mixture liquid including 200 parts of styrene monomer and 4.2 parts of n-octanethiol in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-1 containing white fine vinyl resin particles having a volume average particle diameter of 130 nm is prepared. The solid content is about 25%. Put 2 ml of the fine vinyl resin particle dispersion liquid V-1 on a petri dish and vaporize the dispersion solvent. The dried residue has a number average molecular weight of 9,500, a weight average molecular weight of 18,000, and a glass transition temperature of 83° C.

Preparation of Fine Vinyl Resin Particle Dispersion Liquid V-2

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.5 parts of potassium persulfate are dissolved in 98 parts of ion-exchange water to the vessel. After 15 minutes, drop a monomer mixture liquid including 160 parts of styrene monomer and 40 parts of methoxypolyethylene glycol methacrylate (ED=2 mol) (M-20G from Shin-Nakamura Chemical Co., Ltd.) in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-2 containing white fine vinyl resin particles having a volume average particle diameter of 115 nm is prepared. The solid content is about 25%. Put 2 ml of the fine vinyl resin particle dispersion liquid V-2 on a petri dish and vaporize the dispersion solvent. The dried residue has a number average molecular weight of 98,000, a weight average molecular weight of 420,000, and a glass transition temperature of 70° C.

Preparation of Fine Vinyl Resin Particle Dispersion Liquid V-3

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.7 parts of potassium persulfate are dissolved in 108 parts of ion-exchange water to the vessel. After 15 minutes, drop a monomer mixture liquid including 160 parts of styrene monomer and 40 parts of methyl methacrylate in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-3 containing white fine vinyl resin particles having a volume average particle diameter of 100 nm is prepared. The solid content is about 25%. Put 2 ml of the fine vinyl resin particle dispersion liquid V-3 on a petri dish and vaporize the dispersion solvent. The dried residue has a number average molecular weight of 60,000, a weight average molecular weight of 216,000, and a glass transition temperature of 99° C.

Preparation of Fine Vinyl Resin Particle Dispersion Liquid V-4

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.6 parts of potassium persulfate are dissolved in 102 parts of ion-exchange water to the vessel. After 15 minutes, drop a monomer mixture liquid including 184.6 parts of styrene monomer, 15 parts of butyl acrylate, and 0.5 parts of divinylbenzene in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-4 containing white fine vinyl resin particles having a volume average particle diameter of 79 nm is prepared. The solid content is about 25%. Put 2 ml of the fine vinyl resin particle dispersion liquid V-4 on a petri dish and vaporize the dispersion solvent. The dried residue has a number average molecular weight of 34,000, a weight average molecular weight of 160,000, and a glass transition temperature of 87° C.

Preparation of Fine Vinyl Resin Particle Dispersion Liquid V-5

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.6 parts of potassium persulfate are dissolved in 104 parts of ion-exchange water to the vessel. After 15 minutes, drop a monomer mixture liquid including 200 parts of styrene monomer in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-5 containing white fine vinyl resin particles having a volume average particle diameter of 100 nm is prepared. The solid content is about 25%. Put 2 ml of the fine vinyl resin particle dispersion liquid V-5 on a petri dish and vaporize the dispersion solvent. The dried residue has a number average molecular weight of 62,000, a weight average molecular weight of 215,000, and a glass transition temperature of 101° C.

Preparation of Fine Vinyl Resin Particle Dispersion Liquid V-6

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.6 parts of potassium persulfate are dissolved in 104 parts of ion-exchange water to the vessel. After 15 minutes, drop a monomer mixture liquid including 200 parts of styrene monomer and 14 parts of n-octanethiol in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-6 containing white fine vinyl resin particles having a volume average particle diameter of 103 nm is prepared. The solid content is about 25%. Put 2 ml of the fine vinyl resin particle dispersion liquid V-6 on a petri dish and vaporize the dispersion solvent. The dried residue has a number average molecular weight of 2,700, a weight average molecular weight of 6,700, and a glass transition temperature of 44° C.

Preparation of Fine Vinyl Resin Particle Dispersion Liquid V-7

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.7 parts of potassium persulfate are dissolved in 108 parts of ion-exchange water to the vessel. After 15 minutes, drop a monomer mixture liquid including 100 parts of styrene monomer and 90 parts of methyl methacrylate in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-7 containing white fine vinyl resin particles having a volume average particle diameter of 102 nm is prepared. The solid content is about 25%. Put 2 ml of the fine vinyl resin particle dispersion liquid V-7 on a petri dish and vaporize the dispersion solvent. The dried residue has a number average molecular weight of 57,000, a weight average molecular weight of 186,000, and a glass transition temperature of 100° C.

Preparation of Fine Vinyl Resin Particle Dispersion Liquid V-8

Mix 100 parts of the fine vinyl resin particle dispersion liquid V-1 with 100 parts of the fine vinyl resin particle dispersion liquid V-4. Thus, a fine vinyl resin particle dispersion liquid V-8 is prepared. The solid content is about 25%. Put 2 ml of the fine vinyl resin particle dispersion liquid V-8 on a petri dish and vaporize the dispersion solvent. The dried residue has a number average molecular weight of 27,000, a weight average molecular weight of 90,000, and a glass transition temperature of 85° C.

Preparation of Fine Vinyl Resin Particle Dispersion Liquid V-9

Charge a reaction vessel equipped with a condenser, a stirrer, and a nitrogen inlet pipe with 0.7 parts of sodium dodecyl sulfate and 498 parts of ion-exchange water. Heat the mixture to 80° C. while agitating it so that the sodium dodecyl sulfate is dissolved in the ion-exchange water. Add a solution in which 2.5 parts of potassium persulfate are dissolved in 98 parts of ion-exchange water to the vessel. After 15 minutes, drop a monomer mixture liquid including 130 parts of styrene monomer and 70 parts of methoxypolyethylene glycol methacrylate in the vessel over a period of 90 minutes. Keep the mixture at 80° C. for subsequent 60 minutes and subject it to a polymerization reaction.

Cool the mixture thereafter. Thus, a fine vinyl resin particle dispersion liquid V-9 containing white fine vinyl resin particles having a volume average particle diameter of 115 nm is prepared. The solid content is about 25%. Put 2 ml of the fine vinyl resin particle dispersion liquid V-9 on a petri dish and vaporize the dispersion solvent. The dried residue has a number average molecular weight of 87,600, a weight average molecular weight of 392,000, and a glass transition temperature of 48° C.

Properties of the above-prepared vinyl resins are shown in Table 2.

TABLE 2

| | Composition (parts by weight) | | | | | Properties | | | |
|---|---|---|---|---|---|---|---|---|---|
| Resin | Styrene | Methoxypolyethylene glycol methacrylate | Divinylbenzene | Butyl acrylate | Methyl methacrylate | Tg (° C.) | Volume average particle diameter (nm) | Dv/Dn | Mw |
| V-1 | 200 | 0 | 0 | 0 | 0 | 83 | 130 | 1.12 | 18,000 |
| V-2 | 160 | 40 | 0 | 0 | 0 | 70 | 115 | 1.16 | 420,000 |
| V-3 | 160 | 0 | 0 | 0 | 40 | 99 | 100 | 1.17 | 216,000 |
| V-4 | 184.6 | 0 | 0.5 | 15 | 0 | 87 | 79 | 1.24 | 160,000 |
| V-5 | 200 | 0 | 0 | 0 | 0 | 101 | 100 | 1.24 | 215,000 |
| V-6 | 200 | 0 | 0 | 0 | 0 | 44 | 103 | 1.14 | 6,700 |
| V-7 | 100 | 0 | 0 | 0 | 90 | 100 | 102 | 1.11 | 186,000 |
| V-8 | 192.3 | 0 | 0.25 | 7.5 | 0 | 85 | 112 | 1.31 | 90,000 |
| V-9 | 130 | 70 | 0 | 0 | 0 | 48 | 115 | 1.15 | 392,000 |

Example 1

Preparation of Resin Solution

Charge a reaction vessel equipped with a thermometer and a stirrer with 100 parts of the crystalline polyester resin C-1 and 100 parts of ethyl acetate. Heat the mixture to 50° C. and uniformly agitate it. Thus, a resin solution 1 is prepared.

Charge a beaker with 60 parts of the resin solution 1, 27 parts of the wax dispersion liquid, and 10 parts of the colorant dispersion liquid 1. Uniformly agitate the mixture with a TK HOMOMIXER at a revolution of 8,000 rpm at 50° C. Thus, a toner constituent liquid 1 is prepared.

Charge another beaker with 97 parts of ion-exchange water, 6 parts of a 25% aqueous dispersion of fine organic resin particles (i.e., a copolymer of styrene, butyl acrylate, sodium salt of sulfate ester of ethylene oxide adduct of methacrylic acid), 1 part of sodium carboxymethylcellulose, and 10 parts of a 48.5% aqueous solution of dodecyl diphenyl ether sodium disulfonate (ELEMINOL MON-7 from Sanyo Chemical Industries, Ltd.). Uniformly agitate the mixture.

Add 75 parts of the toner constituent liquid to the beaker at 50° C. while agitating the mixture with a TK HOMOMIXER at a revolution of 10,000 rpm. Further agitate the mixture for 2 minutes. Thus, a slurry 1 is prepared.

Process of Forming Projections (Process of Adhering Fine Resin Particles to Core Particles)

While agitating the slurry 1 with a THREE-ONE MOTOR at a revolution of 200 rpm at 25° C., drop 21.4 parts of the fine vinyl resin particle dispersion liquid V-1 in the slurry 1 over a period of 5 minutes. Keep agitating the mixture for 30 minutes. Take out a small amount of the slurry, dilute it with 10 times as much water, and subject it to centrifugal separation.

As a result, core particles settle down at the bottom of a test tube while the supernatant liquid being substantially transparent. Thus, a projection-formed slurry 1 is prepared.

Solvent Removal

Subject the projection-formed slurry 1 to solvent removal for 8 hours at 30° C. in a vessel equipped with a stirrer and a thermometer. Thus, a dispersion slurry 1 is prepared.

Washing and Drying

Filter 100 parts of the dispersion slurry 1 under reduced pressure.

(1) Mix the filtration residue with 100 parts of ion-exchange water with a TK HOMOMIXER for 10 minutes at a revolution of 12,000 rpm and subject the mixture to a filtration.

(2) Mix the filtration residue with 100 parts of ion-exchange water with a TK HOMOMIXER for 30 minutes at a revolution of 12,000 rpm while applying ultrasonic vibration. Subject the mixture to a filtration under reduced pressure. Repeat this operation until the re-slurry liquid exhibits an electric conductivity of 10 μS/cm or less.

(3) Add a 10% solution of hydrochloric acid to the re-slurry liquid until the re-slurry liquid exhibits a pH of 4. Agitate the re-slurry liquid for 30 minutes with a THREE-ONE MOTOR and subject it to a filtration.

(4) Mix the filtration residue with 100 parts of ion-exchange water with a TK HOMOMIXER for 10 minutes at a revolution of 12,000 rpm and subject the mixture to a filtration. Repeat this operation until the re-slurry liquid exhibits an electric conductivity of 10 μS/cm or less. Thus, a filtered cake 1 is obtained.

Subject the remaining dispersion slurry 1 to the same procedure and add the resulting filtered cake to the above filtered cake 1.

Dry the filtered cake 1 by a circulating drier for 48 hours at 45° C. and sieve it with a mesh having openings of 75 μm. Thus, a mother toner 1 is prepared. Mix 50 parts of the mother toner 1 with 1 part of a hydrophobized silica having a primary particle diameter of about 30 nm and 0.5 parts of a hydrophobized silica having a primary particle diameter of about 10 nm with a HENSCHEL MIXER. Thus, a toner 1 is prepared. Subject the toner 1 to an observation with a scanning electron microscopy (SEM) to determine the lengths of the long sides of the projections and the surface coverage of the toner with the projections. The average length of the long sides of the projections is 0.24 μm, the standard deviation of the lengths of the long sides of the projections is 0.132, and the surface coverage of the toner with the projections is 57%.

Example 2

Charge a reaction vessel equipped with a thermometer and a stirrer with 95 parts of the crystalline polyester resin C-1, 5 parts of the amorphous polyester resin A-1, and 100 parts of ethyl acetate. Heat the mixture to 50° C. and uniformly agitate it. Thus, a resin solution 2 is prepared. Repeat the procedure for preparing the toner 1 except for replacing the resin solution 1 with the resin solution 2. Thus, a toner 2 is prepared.

Example 3

Repeat the procedure for preparing the toner 1 except for replacing the fine vinyl resin particle dispersion liquid V-1 with the fine vinyl resin particle dispersion liquid V-2. Thus, a toner 2 is prepared.

Example 4

Repeat the procedure for preparing the toner 1 except for replacing the fine vinyl resin particle dispersion liquid V-1 with the fine vinyl resin particle dispersion liquid V-3. Thus, a toner 4 is prepared.

Example 5

Repeat the procedure for preparing the toner 1 except for replacing the fine vinyl resin particle dispersion liquid V-1 with the fine vinyl resin particle dispersion liquid V-4. Thus, a toner 5 is prepared.

Example 6

Repeat the procedure for preparing the toner 1 except for replacing the fine vinyl resin particle dispersion liquid V-1 with the fine vinyl resin particle dispersion liquid V-4 and changing the amount thereof from 21.4 parts to 11.4 parts. Thus, a toner 6 is prepared.

Example 7

Repeat the procedure for preparing the toner 1 except for replacing the crystalline polyester resin C-1 with the crystalline polyester resin C-2. Thus, a toner 7 is prepared.

Example 8

Repeat the procedure for preparing the toner 1 except for replacing the crystalline polyester resin C-1 with the crystalline polyester resin C-3. Thus, a toner 8 is prepared.

Example 9

Repeat the procedure for preparing the toner 1 except for replacing the crystalline polyester resin C-1 with the crystalline polyester resin C-4. Thus, a toner 9 is prepared.

Example 10

Repeat the procedure for preparing the toner 1 except for replacing the crystalline polyester resin C-1 with the crystalline polyester resin C-5. Thus, a toner 10 is prepared.

Example 11

Repeat the procedure for preparing the toner 1 except for replacing the fine vinyl resin particle dispersion liquid V-1 with the fine vinyl resin particle dispersion liquid V-5. Thus, a toner 11 is prepared.

Example 12

Repeat the procedure for preparing the toner 1 except for replacing the fine vinyl resin particle dispersion liquid V-1 with the fine vinyl resin particle dispersion liquid V-6. Thus, a toner 12 is prepared.

Example 13

Repeat the procedure for preparing the toner 1 except for replacing the fine vinyl resin particle dispersion liquid V-1 with the fine vinyl resin particle dispersion liquid V-7. Thus, a toner 13 is prepared.

Example 14

Charge a reaction vessel equipped with a thermometer and a stirrer with 75 parts of the crystalline polyester resin C-1, 25 parts of the amorphous polyester resin A-1, and 100 parts of ethyl acetate. Heat the mixture to 50° C. and uniformly agitate it. Thus, a resin solution 14 is prepared. Repeat the procedure for preparing the toner 1 except for replacing the resin solution 1 with the resin solution 14. Thus, a toner 14 is prepared.

Example 15

Repeat the procedure for preparing the toner 1 except for replacing the crystalline polyester resin C-1 with 90 parts of the crystalline polyester resin C-1 and 10 parts of the modified polyester resin D-1. Thus, a toner 15 is prepared.

Example 16

Repeat the procedure for preparing the toner 1 except for replacing the crystalline polyester resin C-1 with the crystalline polyurea resin E-1. Thus, a toner 16 is prepared.

Example 17

Repeat the procedure for preparing the toner 1 except for replacing the crystalline polyester resin C-1 with 70 parts of the urethane-modified crystalline polyester resin F-2 and 30 parts of the crystalline resin precursor G-1. Thus, a toner 17 is prepared.

Comparative Example 1

Repeat the procedure for preparing the toner 1 except for replacing the crystalline polyester resin C-1 with the amorphous polyester resin A-1. Thus, a toner 16 is prepared.

Comparative Example 2

Repeat the procedure for preparing the toner 1 except that the process of forming projection is not performed. Thus, a toner 17 is prepared. As a result of a SEM observation of the toner 17, the surface is observed to be substantially smooth and to have no projection having a long side of 0.15 μm or more.

Comparative Example 3

Repeat the procedure for preparing the toner 1 except that the fine vinyl resin particle dispersion liquid V-1 is previously added to the aqueous phase and the process of forming projection is not performed. Thus, a toner 18 is prepared.

Comparative Example 4

Repeat the procedure for preparing the toner 1 except for replacing the fine vinyl resin particle dispersion liquid V-1 with the fine vinyl resin particle dispersion liquid V-8. Thus, a toner 19 is prepared.

Comparative Example 5

Repeat the procedure for preparing the toner 1 except for replacing the fine vinyl resin particle dispersion liquid V-1 with the fine vinyl resin particle dispersion liquid V-9. Thus, a toner 20 is prepared.

Comparative Example 6

Repeat the procedure for preparing the toner 1 except for changing the amount of the fine vinyl resin particle dispersion liquid V-1 from 21.4 parts to 107 parts and 21 parts of the 48.5% aqueous solution of dodecyl diphenyl ether sodium disulfonate is added at the same time as the fine vinyl resin particle dispersion liquid V-1 is added. Thus, a toner 21 is prepared.

Properties of the above-prepared toners are shown in Tables 3-1 and 3-2. In Tables 3-1 and 3-2, "Binder Resin 1" represents a crystalline polyester resin.

TABLE 3-1

| | Binder resin 1 | Binder resin 2 | Projection resin | Tm of toner (° C.) | Mw of toner | G' (70) of toner | G' (160) of toner | Tsh2nd/ Tsh1st | Ratio of crystalline resin (%) |
|---|---|---|---|---|---|---|---|---|---|
| Example 1 | C-1 | — | V-1 | 63 | 31,000 | $2.5 \times 10^5$ | $3.1 \times 10^3$ | 1.00 | 67 |
| Example 2 | C-1 | A-1 | V-1 | 63 | 30,000 | $2.6 \times 10^5$ | $5.0 \times 10^3$ | 0.95 | 64 |
| Example 3 | C-1 | — | V-2 | 65 | 68,000 | $5.6 \times 10^4$ | $6.8 \times 10^3$ | 1.05 | 67 |
| Example 4 | C-1 | — | V-3 | 66 | 50,000 | $4.0 \times 10^5$ | $5.0 \times 10^3$ | 0.98 | 67 |
| Example 5 | C-1 | — | V-4 | 65 | 44,000 | $3.5 \times 10^5$ | $4.4 \times 10^3$ | 0.97 | 67 |
| Example 6 | C-1 | — | V-4 | 64 | 37,000 | $3.0 \times 10^5$ | $3.7 \times 10^3$ | 1.10 | 71 |
| Example 7 | C-2 | — | V-1 | 71 | 15,000 | $1.2 \times 10^5$ | $6.0 \times 10^3$ | 1.05 | 67 |
| Example 8 | C-3 | — | V-1 | 45 | 11,000 | $8.8 \times 10^4$ | $1.1 \times 10^3$ | 1.00 | 67 |
| Example 9 | C-4 | — | V-1 | 67 | 49,000 | $3.9 \times 10^5$ | $4.9 \times 10^3$ | 1.00 | 67 |
| Example 10 | C-5 | — | V-1 | 60 | 12,000 | $9.6 \times 10^4$ | $1.2 \times 10^3$ | 0.90 | 67 |
| Example 11 | C-1 | — | V-5 | 65 | 49,000 | $3.9 \times 10^5$ | $4.9 \times 10^3$ | 0.99 | 67 |
| Example 12 | C-1 | — | V-6 | 65 | 30,000 | $2.0 \times 10^5$ | $3.0 \times 10^3$ | 1.10 | 67 |
| Example 13 | C-1 | — | V-7 | 65 | 46,000 | $3.7 \times 10^5$ | $4.6 \times 10^3$ | 1.05 | 67 |
| Example 14 | C-1 | A-1 | V-1 | 62 | 30,000 | $2.4 \times 10^5$ | $7.0 \times 10^3$ | 0.90 | 51 |
| Example 15 | C-1 | D-1 | V-2 | 61 | 42,000 | $3.4 \times 10^5$ | $4.2 \times 10^3$ | 0.98 | 61 |
| Example 16 | E-1 | — | V-1 | 63 | 43,000 | $3.4 \times 10^5$ | $4.3 \times 10^3$ | 0.97 | 67 |
| Example 17 | F-1 | G-1 | V-1 | 67 | 45,000 | $3.6 \times 10^5$ | $4.5 \times 10^3$ | 0.99 | 67 |
| Comparative Example 1 | — | A-1 | V-1 | — | 8,000 | $6.4 \times 10^4$ | $1.2 \times 10^4$ | 1.02 | 0 |
| Comparative Example 2 | C-1 | — | — | 65 | 33,000 | $2.6 \times 10^5$ | $3.3 \times 10^3$ | 1.00 | 67 |
| Comparative Example 3 | C-1 | — | V-1 | 65 | 31,000 | $2.5 \times 10^5$ | $2.0 \times 10^4$ | 1.03 | 67 |
| Comparative Example 4 | C-1 | — | V-8 | 64 | 37,000 | $3.0 \times 10^5$ | $7.0 \times 10^3$ | 0.96 | 67 |
| Comparative | C-1 | — | V-9 | 65 | 68,000 | $5.0 \times 10^5$ | $4.0 \times 10^3$ | 0.95 | 67 |

TABLE 3-1-continued

| | Binder resin 1 | Binder resin 2 | Projection resin | Tm of toner (° C.) | Mw of toner | G' (70) of toner | G' (160) of toner | Tsh2nd/ Tsh1st | Ratio of crystalline resin (%) |
|---|---|---|---|---|---|---|---|---|---|
| Example 5 | | | | | | | | | |
| Comparative Example 6 | C-1 | — | V-1 | 66 | 35,000 | $3.5 \times 10^5$ | $2.5 \times 10^4$ | 0.98 | 46 |

TABLE 3-2

| | Binder resin 1 | Binder resin 2 | Projection resin | Average length of long sides of projections (μm) | Standard deviation of lengths of long sides of projections | Surface coverage (%) | Mw of projection resin | Tg of projection resin | Ratio of projection resin (%) |
|---|---|---|---|---|---|---|---|---|---|
| Example 1 | C-1 | — | V-1 | 0.24 | 0.132 | 57 | 18,000 | 84 | 9.0 |
| Example 2 | C-1 | A-1 | V-1 | 0.23 | 0.142 | 56 | 18,000 | 84 | 9.0 |
| Example 3 | C-1 | — | V-2 | 0.47 | 0.123 | 51 | 420,000 | 70 | 9.1 |
| Example 4 | C-1 | — | V-3 | 0.18 | 0.183 | 59 | 216,000 | 99 | 9.0 |
| Example 5 | C-1 | — | V-4 | 0.22 | 0.162 | 84 | 160,000 | 87 | 9.1 |
| Example 6 | C-1 | — | V-4 | 0.25 | 0.133 | 33 | 160,000 | 87 | 4.8 |
| Example 7 | C-2 | — | V-1 | 0.22 | 0.168 | 56 | 18,000 | 84 | 9.0 |
| Example 8 | C-3 | — | V-1 | 0.26 | 0.149 | 59 | 18,000 | 84 | 9.0 |
| Example 9 | C-4 | — | V-1 | 0.23 | 0.120 | 56 | 18,000 | 84 | 9.0 |
| Example 10 | C-5 | — | V-1 | 0.22 | 0.126 | 58 | 18,000 | 84 | 9.0 |
| Example 11 | C-1 | — | V-5 | 0.22 | 0.093 | 62 | 215,000 | 101 | 9.1 |
| Example 12 | C-1 | — | V-6 | 0.21 | 0.122 | 59 | 6,700 | 49 | 8.9 |
| Example 13 | C-1 | — | V-7 | 0.21 | 0.103 | 59 | 186,000 | 100 | 8.7 |
| Example 14 | C-1 | A-1 | V-1 | 0.22 | 0.152 | 52 | 18,000 | 84 | 9.0 |
| Example 15 | C-1 | D-1 | V-2 | 0.22 | 0.131 | 51 | 18,000 | 84 | 9.0 |
| Example 16 | E-1 | — | V-1 | 0.23 | 0.168 | 56 | 18,000 | 84 | 9.0 |
| Example 17 | F-1 | G-1 | V-1 | 0.22 | 0.131 | 51 | 18,000 | 84 | 9.0 |
| Comparative Example 1 | — | A-1 | V-1 | 0.23 | 0.400 | 56 | 18,000 | 84 | 9.0 |
| Comparative Example 2 | C-1 | — | — | — | — | 0 | — | — | 0.0 |
| Comparative Example 3 | C-1 | — | V-1 | 0.75 | 0.502 | 58 | 18,000 | 84 | 9.0 |
| Comparative Example 4 | C-1 | — | V-8 | 0.19 | 0.323 | 64 | 90,000 | 85 | 8.6 |
| Comparative Example 5 | C-1 | — | V-9 | 0.52 | 0.198 | 67 | 392,000 | 48 | 9.8 |
| Comparative Example 6 | C-1 | — | V-1 | 0.45 | 0.195 | 98 | 18,000 | 84 | 31.0 |

Evaluation results of the above-prepared toners are shown in Table 4.

TABLE 4

| | Evaluation results | | | |
|---|---|---|---|---|
| | Chargeability | Resistance to sticking | Fixability | Heat-resistant storage stability |
| Example 1 | A | A | A | A |
| Example 2 | A | A | B | A |
| Example 3 | C | B | C | B |
| Example 4 | B | C | A | B |
| Example 5 | C | A | B | A |
| Example 6 | B | C | A | C |
| Example 7 | A | A | C | A |
| Example 8 | B | B | A | C |
| Example 9 | B | A | C | B |
| Example 10 | B | B | A | C |
| Example 11 | A | A | C | A |
| Example 12 | A | C | A | C |
| Example 13 | C | A | B | A |
| Example 14 | A | B | C | A |
| Example 15 | A | A | A | A |
| Example 16 | A | B | B | A |

TABLE 4-continued

| | Evaluation results | | | |
|---|---|---|---|---|
| | Chargeability | Resistance to sticking | Fixability | Heat-resistant storage stability |
| Example 17 | A | A | A | A |
| Comparative Example 1 | A | A | D | B |
| Comparative Example 2 | D | D | D | D |
| Comparative Example 3 | A | A | D | B |
| Comparative Example 4 | C | B | C | D |
| Comparative Example 5 | D | D | B | D |
| Comparative Example 6 | A | A | D | A |

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising:

a core particle, the core particle including a binder resin and a colorant, the binder resin including a crystalline resin as a major component; and projections at a surface of the core particle, each of the projections consisting of a fine resin particle, wherein an average length of long sides of the projections is not less than 0.15 μm and less than 0.5 μm, wherein a standard deviation of lengths of the long sides of the projections is 0.2 or less, wherein a surface coverage of the toner with the projections is within a range of 30 to 90%, and wherein, when the toner is subjected to first and second heating processes by a differential scanning calorimeter, a ratio (Tsh2nd/Tsh1st) of a second shoulder temperature (Tsh2nd) of a second peak of melting heat observed in the second heating process to a first shoulder temperature (Tsh1st) of a first peak of melting heat observed in the first heating process is within a range of 0.90 to 1.10.

2. The toner according to claim 1, wherein the toner satisfies the following formula (1):

$$50 \leq Tm1 \leq 70 \quad (1)$$

wherein Tm1 (° C.) represents a melting point of the crystalline resin.

3. The toner according to claim 1, wherein the toner satisfies the following formula (2):

$$10{,}000 \leq Mw \leq 40{,}000 \quad (2)$$

wherein Mw represents a weight average molecular weight of the crystalline resin.

4. The toner according to claim 1, wherein the crystalline resin includes a first crystalline resin and a second crystalline resin, wherein a weight average molecular weight of the second crystalline resin is greater than that of the first crystalline resin, and wherein the first crystalline resin includes a crystalline polyester.

5. The toner according to claim 4, wherein the second crystalline resin includes a crystalline resin having urethane and/or urea bond in its backbone.

6. The toner according to claim 4, wherein the second crystalline resin is obtained by elongating a modified crystalline resin having an isocyanate group on its terminal.

7. The toner according to claim 1, wherein the crystalline resin includes a first crystalline resin and a second crystalline resin, wherein a weight average molecular weight of the second crystalline resin is greater than that of the first crystalline resin, and wherein the first crystalline resin includes a crystalline resin having urethane and/or urea bond in its backbone.

8. The toner according to claim 1, wherein the toner satisfies the following formulae:

$$5.0\times10^4 < G'(70) < 5.0\times10^5$$

$$1.0\times10^3 < G'(160) < 1.0\times10^4$$

wherein G'(70) and G'(160) represent a storage elastic modulus (Pa) of the toner at 70° C. and 160° C., respectively.

9. The toner according to claim 1, wherein the toner satisfies the following formula (3):

$$45 \leq Tg \leq 100 \quad (3)$$

wherein Tg (° C.) represents a glass transition temperature of the fine resin particle.

10. The toner according to claim 1, wherein the toner satisfies the following formula (4):

$$Tm2 < Tg \quad (4)$$

wherein Tm2 (° C.) represents a melting point of the toner and Tg (° C.) represents a glass transition temperature of the fine resin particle.

11. The toner according to claim 1, wherein the fine resin particle includes a resin obtained by polymerizing a mixture of monomers including styrene monomer in an amount 70% by weight or more.

12. The toner according to claim 1, wherein the fine resin particle accounts for 1 to 20% by weight of the toner.

13. An image forming apparatus, comprising:

a latent image bearing member adapted to bear a latent image;

a charger adapted to uniformly charge a surface of the latent image bearing member;

an irradiator adapted to irradiate the charged surface of the latent image bearing member with light based on image data to write an electrostatic latent image thereon;

a developing device containing the toner according to claim 1, the developing device being adapted to develop the electrostatic latent image with the toner to form a toner image;

a transfer device adapted to transfer the toner image from the latent image bearing member onto a transfer medium; and a fixing device adapted to fix the toner image on the transfer medium.

* * * * *